US011408426B2

(12) United States Patent
Jeon et al.

(10) Patent No.: US 11,408,426 B2
(45) Date of Patent: Aug. 9, 2022

(54) COMPRESSOR

(71) Applicant: LG Electronics Inc., Seoul (KR)

(72) Inventors: Nayoung Jeon, Seoul (KR); Taekyoung Kim, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 217 days.

(21) Appl. No.: 16/788,966

(22) Filed: Feb. 12, 2020

(65) Prior Publication Data

US 2020/0256600 A1 Aug. 13, 2020

(30) Foreign Application Priority Data

Feb. 12, 2019 (KR) ..... 10-2019-0015921

(51) Int. Cl.
*F04C 29/02* (2006.01)
*F04C 18/02* (2006.01)

(52) U.S. Cl.
CPC ..... *F04C 29/026* (2013.01); *F04C 18/0215* (2013.01); *F04C 2240/40* (2013.01); *F04C 2240/807* (2013.01)

(58) Field of Classification Search
CPC F04C 29/026; F04C 2240/40; F04C 2240/60; F04C 2240/603; F04C 2240/20;
(Continued)

(56) References Cited

U.S. PATENT DOCUMENTS 1,967,034 A * 7/1934 Lipman ..... F25B 1/04 417/372
2,124,239 A * 7/1938 Smith ..... F25B 31/026 417/372

(Continued)

FOREIGN PATENT DOCUMENTS

JP 54137912 U * 9/1979
JP H0350314 10/1991

(Continued)

OTHER PUBLICATIONS

Extended European Search Report in European Application No. 20156884.7, dated Jul. 13, 2020, 8 pages.

*Primary Examiner* — Mark A Laurenzi
*Assistant Examiner* — Xiaoting Hu
(74) *Attorney, Agent, or Firm* — Fish & Richardson P.C.

(57) ABSTRACT

A compressor include a casing, a drive unit including a stator and a rotor accommodated in the stator, a rotation shaft coupled to the rotor and configured to be rotated by the rotor, a compression unit that is coupled to the rotation shaft, that is lubricated with the oil, and that is configured to compress and discharge the refrigerant, and an oil-separator that is disposed between the discharge part and the drive unit and that is configured to separate the oil from the refrigerant and guide the refrigerant to the discharge part. The oil-separator includes a centrifugal separator configured to rotate together with the rotation shaft and configured to generate a centrifugal force to separate the oil from the refrigerant, and a
(Continued)

coupler coupled to the rotor or the rotation shaft and configured to rotate the centrifugal separator based on rotation of the rotating shaft.

24 Claims, 12 Drawing Sheets

(58) Field of Classification Search
CPC ..... F04C 29/028; F04C 2240/805; F04C 18/0215; F04C 2240/807
See application file for complete search history.

(56) References Cited

U.S. PATENT DOCUMENTS 3,176,914 A * 4/1965 Rinehart ..... F25B 31/02 417/372
4,717,316 A 1/1988 Muramatsu et al.
4,762,471 A * 8/1988 Asanuma ..... F04C 29/026 417/372
6,533,558 B1 * 3/2003 Matsumoto ..... F04C 29/026 417/410.3
8,337,185 B2 * 12/2012 Tanaka ..... F04C 18/3564 418/270
2006/0067846 A1 * 3/2006 Okaichi ..... F04C 18/3441 418/47
2007/0154334 A1 * 7/2007 Amano ..... F04C 29/026 417/424.1
2012/0189470 A1 * 7/2012 Okaichi ..... F04C 29/023 417/321
2015/0052936 A1 * 2/2015 Yokoyama ..... F25B 1/04 62/470

FOREIGN PATENT DOCUMENTS

JP 04043892 A * 2/1992
JP H04043892 2/1992
JP 05061487 8/1993
JP H0561487 U * 8/1993
JP H09151886 6/1997
JP H10103236 4/1998
JP 2005201171 7/2005
JP 2009228668 10/2009
JP 2010265849 11/2010
JP 2010265849 A * 11/2010
JP 2011106348 A * 6/2011
JP 2012202378 10/2012
JP 6344452 6/2018
KR 20110075530 A * 7/2011
KR 1020180090677 8/2018
KR 10-2018-0124633 11/2018
KR 10-2018-0124636 11/2018
KR 1020180124633 11/2018
KR 1020180124636 11/2018

* cited by examiner

COMPRESSOR

CROSS-REFERENCE TO RELATED APPLICATIONS

This application claims priority to and the benefit of Korean Patent Application No. 10-2019-0015921, filed on Feb. 12, 2019, which is hereby incorporated by reference as when fully set forth herein.

TECHNICAL FIELD

The present disclosure relates to a compressor. More specifically, the present disclosure relates to a compressor including an oil centrifuge that improves a separation efficiency and an oil-separator that separates oil from refrigerant and that is coupled to a drive unit providing power to compress the refrigerant.

BACKGROUND

A compressor may perform a refrigeration cycle for a refrigerator or an air conditioner. For example, the compressor may compress refrigerant to enable heat exchange in the refrigeration cycle.

The compressors may be classified into a reciprocating type, a rotary type, and a scroll type based on a method for compressing the refrigerant. For example, the scroll compressor may perform an orbiting motion by an orbiting scroll with a fixed scroll in an internal space of a sealed container. The compressor may define a compression chamber between a fixed wrap of the fixed scroll and an orbiting wrap of the orbiting scroll.

Compared with other types of the compressors, the scroll compressor may obtain a relatively high compression ratio because the refrigerant is continuously compressed through the scrolls engaged with each other, and may obtain a stable torque because suction, compression, and discharge of the refrigerant proceed smoothly. The scroll compressor may be used for compressing the refrigerant in the air conditioner and the like.

In some examples, a scroll compressor may include a casing forming an outer shape of the compressor and having a discharge part for discharging refrigerant, a compression unit fixed to the casing to compress the refrigerant, and a drive unit fixed to the casing to drive the compression unit, and the compression unit and the drive unit are coupled to a rotation shaft that is coupled to the driver and rotates.

The compression unit may include a fixed scroll fixed to the casing and having a fixed wrap, and an orbiting scroll including an orbiting wrap operated in a state of being engaged with the fixed wrap by the rotation shaft. The scroll compressor may include the rotation shaft that is eccentric, and the orbiting scroll fixed to the eccentric rotation shaft and rotating. The orbiting scroll may orbit along the fixed scroll and compress the refrigerant.

The compression unit may be disposed below the discharge part, and the drive unit may be disposed below the compression unit. Further, the rotation shaft may have one end coupled to the compression unit and the other end passing through the drive unit.

In some cases, the scroll compressor may have difficulty in supplying oil into the compression unit because the compression unit is disposed above the drive unit and is close to the discharge part. In some cases, the scroll compressor may require a lower frame to separately support the rotation shaft connected to the compression unit below the drive unit. In some cases, where a point of applications of a gas force generated by the refrigerant inside the compressor and a point of a reaction force supporting the gas force do not match, the scroll may tilt and decrease an efficiency and a reliability thereof.

FIG. 1A illustrates an example of a lower scroll compressor in related art that includes a drive unit below a discharge part and a compression unit below the drive unit has emerged.

For instance, the drive unit is disposed closer to the discharge part than the compression unit, and the compression unit is disposed farthest away from the discharge part.

The lower scroll compressor may have one end of the rotation shaft connected to the drive unit and the other end supported by the compression unit, thereby omitting the lower frame. The oil stored at a lower portion of the casing may be directly supplied to the compression unit without passing the drive unit. In some cases, in the lower scroll compressor, when the rotation shaft is connected through the compression unit, the points of applications of the gas force and the reaction force may match on the rotation shaft to offset a vibration and an upsetting moment of the scroll, thereby ensuring the efficiency and the reliability thereof.

In some examples, the oil supplied to the compression unit 1300 through the rotation shaft 1230 may lubricate inside of the compression unit 1300 and simultaneously cool the compression unit 1300 to prevent wear and overheating of the compression unit 1300. In some cases, the oil supplied to the compression unit 1300 may be diluted with the refrigerant when the refrigerant is discharged from the compression unit 1300 and passes through the drive unit 200 and the oil flows towards the discharge part 1121 together with the refrigerant.

In some cases, the compressed refrigerant and oil may exist together in a space between the drive unit 1200 and the discharge part 1121. For example, the oil may have a density and a viscosity greater than those of the refrigerant, so that the oil may be recovered again to an oil storage space of the casing through a recovery passage d-cut defined in outer circumferential surfaces of the drive unit and the compression unit, and the refrigerant is discharged through the discharge part 1121.

In some cases, when a rate at which the refrigerant is discharged to the discharge part 1121 is high or a pressure of the refrigerant is high, the oil may be unintentionally discharged to the discharge part 1121 together with the refrigerant. When the oil is discharged to the discharge part 1121, because the oil is circulated throughout the refrigerant cycle to which the compressor is connected, a reliability or an efficiency of the refrigerant cycle may be reduced. In some cases, where the oil is not recovered into the casing 1100, the oil that lubricates or cools the compression unit 1300 may be reduced, a friction loss of the compression unit may occur, and the compression unit 1300 may be worn or overheated.

In one example, the lower scroll compressor may have a space where the compression unit 1300 is not disposed between the drive unit 1200 and the discharge part 1121. In some cases, the lower scroll compressor was able to prevent the oil from flowing to the discharge part 1121 by installing an oil separating member in the space between the drive unit 1200 and the discharge part 1121 to separate the oil from the refrigerant.

Referring to FIG. 1A, the compressor may include a filter-type separating member that separates the refrigerant and the oil by a density difference therebetween by inducing collision between oil particles (a demister-type or a meshtype oil member 1610 or 1620). The filter-type separating member may include a plate 1610 having a disc or cone shape and having a through-hole defined therein and a filter member 1620 coupled to the through-hole.

The plate 1610 is provided to recover the oil and the refrigerant passed through the drive unit 1200 to the filter member 1620, and then guide the oil separated from the filter member 1620 back to the oil storage space of the casing. The filter member 1620 is provided with a filter of a porous material for being in contact with or passing the oil and the refrigerant guided along the plate 1610. Because the refrigerant is in a gaseous state, the refrigerant passes through the filter member 1620 as it is. However, because the oil is in a particulate droplet state, the oil is adsorbed to the filter member 1620 and grows into a large droplet. Thereafter, the oil remains in the filter member 1620 due to a density difference, and the remaining oil flows along the plate 1610 by a weight thereof and is recovered into the oil storage space.

In one example, the more the oil collides with the filter member 1620, the more the oil is recovered, so that the faster the rate of the oil flowing into the filter member 1620 or the greater the weight (or the density), the better. However, the high flow rate of the oil means that the flow rate of the refrigerant is high, and this means that the refrigerant is compressed at a higher pressure, so that it may mean that a pressure difference is very large in front of and behind the filter member 1620 and in front of and behind the discharge part 1121. Therefore, the oil adsorbed to the filter member 1620 receives a force for separating the oil from the filter member 1620 again by the pressure difference or a pressure drop, thereby causing an adverse effect of the oil flowing out to the discharge part 1121 together with the refrigerant.

In some cases, in the filter-type separating member, when the compression unit 1300 compresses the refrigerant at a high speed, the separation efficiency drops drastically, so that, when the compressor is operated at a high speed (e.g., 90 Hz or above), the oil separation efficiency decreases rapidly.

In some cases, the filter-type separating member may have a lower separation efficiency when the compressor compresses the refrigerant at a low speed. For example, this may be because an impact number K of the oil colliding with the filter-type separating member is lowered.

FIG. 1B illustrates an example of an oil separating member using a centrifugal separation method in related art. Referring to FIG. 1B, the oil separating member may be formed as a centrifugal separating member coupled to the drive unit 1200 and rotating together with the rotation shaft 1230 or the rotor 1220.

The centrifugal separating member may rotate strongly to generate a centrifugal force on oil particles. Thereafter, the oil particles collide with each other to grow into a large droplet, and oil of the large droplet is subjected to a greater centrifugal force, so that the oil of the large droplet may collide with an inner wall of the casing and be separated from the refrigerant.

In some cases, the higher the speed, the greater the centrifugal force, so that the oil separation efficiency may be higher when the compressor compresses the refrigerant at a high speed. Thus, the centrifugal separating member is suitable for driving the compressor at a high speed.

In one example, in the scroll compressor, because the rotation shaft 1230 is disposed eccentrically, a balancer 1400 for compensating for the eccentricity of the rotation shaft 1230 may be installed at both ends of the rotor 1220 or one end of the rotor 1220. The centrifugal separating member may be coupled to the balancer 1400 to have a sufficient rotational area. In some cases, the balancer 1400 is made of a material having a large weight and a strong rigidity, and the centrifugal separating member may be firmly coupled to the balancer 400 through a separate fastening member.

In some cases, the centrifugal separating member may be coupled to the balancer 1400 at a position spaced apart from a center of rotation thereof. In some cases, a portion of the centrifugal separating member that is not coupled to the balancer 1400 may vibrate violently whenever the rotation shaft 1230 rotates. The centrifugal separating member may be disposed with the balancer 1400 like a cantilever, so that a free end thereof may vibrate greatly under minute impact and pressure. In addition, when the oil is accommodated in the centrifugal separating member, the vibration may become more severe. Such vibration may weaken a coupling force of the centrifugal separating member and the balancer 1400, and may generate unnecessary noise.

In some cases, the balancer 1400 may be spaced apart from the rotation shaft 1230 in a radial direction of the rotation shaft 1230, so that when the rotation shaft 1230 rotates, the centrifugal force acts on the balancer 1400. As the rotation shaft 1230 rotates at a high speed, the centrifugal force becomes larger. Accordingly, the centrifugal separating member coupled to the balancer 1400 also receives the strong centrifugal force, so that the centrifugal separating member is more likely to be decoupled or separated from the balancer 1400. When the fastening member is made stronger and thicker or when the fastening member includes a plurality of fastening members to improve this, a load of the drive unit 1200 is increased, which causes an adverse effect of lowering the efficiency of the compressor.

In some cases, when the centrifugal separating member is coupled to the balancer 1400, a durability and a stability may not be guaranteed, and the efficiency of the compressor may also be lowered.

In some cases, a center of rotation of the centrifugal separating member of the lower scroll compressor may not be coincident with the rotation shaft 1230. In such cases, because the centrifugal separating member orbits around the rotation shaft 1230, the centrifugal separating member may receive considerable flow resistance, and the flow rate of the refrigerant may be decreased.

In some cases, the centrifugal separating member of the lower scroll compressor in FIG. 1B may have a structural limitation. For example, it may be difficult for the centrifugal separating member to extend beyond an outer circumferential surface of the balancer 1400. This is because, when the centrifugal separating member extends beyond the outer circumferential surface of the balancer 1400, because a portion thereof farthest away from the balancer 1400 becomes further away from the balancer 1400, the above-described cantilever effect is further increased. For example, the scroll compressor may have a low oil separation efficiency because it is difficult for a maximum diameter of the centrifugal separating member to extend beyond the balancer or beyond an outer circumferential surface of the rotor from the rotation shaft.

In some cases, the centrifugal separating member of the lower scroll compressor may have a cup shape to increase a contact area with the oil and to provide the centrifugal force in more regions. In such cases, the separated oil may remain inside the cup. Therefore, the oil may not be recovered into the oil storage space of the casing.

In some cases, the fastening member that couples the centrifugal separating member may interfere with the flow of the refrigerant or the oil, or may be deformed by a temperature and pressure of the refrigerant or the oil.

SUMMARY

The present disclosure describes a compressor in which an oil-separator that uses a centrifugal force to separate oil from refrigerant is directly connected to a rotor or a rotation shaft to suppress occurrence of vibration.

The present disclosure describes a compressor in which a center of rotation of the oil-separator may be coupled to the rotation shaft.

The present disclosure describes a compressor in which both ends of the oil-separator or both sides of the oil-separator may be coupled to the rotor about the center of rotation thereof.

The present disclosure describes a compressor in which the oil-separator may be coupled to the rotation shaft or the rotor even when a portion of the oil-separator is disposed at a free end of a balancer.

The present disclosure describes a compressor in which the oil-separator rotates around the center of rotation but is prevented from orbiting.

The present disclosure describes a compressor in which a diameter of the oil-separator is expended such that the oil-separator is extended beyond an outer circumferential surface of a balancer that compensates for eccentricity of the drive unit and an outer circumferential surface of the rotor, thereby increasing a centrifugal efficiency.

The present disclosure describes a compressor that may immediately discharge oil collected in the oil-separator providing the centrifugal force out of the oil-separator using the centrifugal force.

The present disclosure describes a compressor that may provide a stronger centrifugal force to the refrigerant or the oil at the same volume of the oil-separator itself.

The present disclosure describes a compressor that accommodates or shields an outer circumferential surface of a fastening member coupling the oil-separator with the balancer to prevent separation of deformation of the fastening member.

Purposes of the present disclosure are not limited to the above-mentioned purpose. Other purposes and advantages as not mentioned above may be understood from following descriptions and more clearly understood from implementations of the present disclosure. Further, it will be readily appreciated that the purposes and advantages may be realized by features and combinations thereof as disclosed in the claims.

The present disclosure provides a compressor that couples a rotating member or an oil-separator for separating oil from refrigerant using centrifugation with a drive unit. For example, the oil-separator may include a coupler or a fastening cylinder extending to one end thereof and be coupled to a rotation shaft or to an inner circumferential surface or an exposed face of a rotor. The fastening cylinder may have a rod shape or a cylindrical shape having a hollow defined therein.

The fastening cylinder may be coupled to one end of the rotation shaft such that the oil-separator rotates in a concentric manner with the rotation shaft. In some examples, a center of gravity of the oil-separator may be present at an imaginary linear extension from the rotation shaft, so that the oil-separator may not orbit but only rotate. Therefore, the centrifugal force or a moment of inertia imposed on the coupler may be reduced.

In some implementations, the fastening cylinder is coupled to the rotation shaft or the rotor without being coupled to a portion spaced apart from the rotation shaft to one side, so that the fastening cylinder may be prevented from being disposed at a free and a fixed end of the rotation shaft. In other words, the oil-separator may not be coupled only to the balancer, such as a cantilever, and a central portion of the oil-separator may be coupled to the rotation shaft, or the oil-separator may be non-eccentrically coupled to an inner circumferential surface of the rotor.

The expression "non-eccentrically coupled" may mean that the coupling is symmetrical about the rotation shaft. An angular spacing between a position at which the oil-separator is coupled with the rotor and another position at which the oil-separator is coupled with the rotor may be in a range of 90 degrees to 180 degrees around the rotation shaft.

In some examples, because the oil-separator is coupled to a drive unit along which the refrigerant flows, the oil-separator may be disposed to minimize a passage resistance to the refrigerant. For example, a diameter of the oil-separator may increase in a direction farther away from the rotation shaft, or the oil-separator may be extended in multiple steps.

A separate fastening member that couples the oil-separator to the rotation shaft or the rotor may pass through and be coupled to the fastening cylinder. Therefore, the coupler may be coupled be coupled to the drive unit through the fastening member even when the coupler does not directly in contact with the drive unit. In one example, the coupler may be disposed to accommodate the fastening member therein to minimize an influence on the refrigerant or the oil even when the fastening member rotates. In addition, the coupler may prevent the fastening member from being deformed or decoupled by a pressure or a temperature of the oil or the refrigerant.

The fastening cylinder may be formed in a shape corresponding to a shape of an outer circumferential surface of the fastening member, and may have a diameter corresponding to a diameter of the fastening member. Therefore, the coupler may minimize exposure of the fastening member to a high pressure and high temperature environment.

The fastening cylinder may be disposed inward of a balance weight that compensates for eccentricity of the drive unit. That is, the fastening cylinder may be coupled to the rotation shaft or the rotor spaced apart from the balance weight. In some implementations, the fastening cylinder may be coupled to both of the rotation shaft and the rotor. In addition, the fastening cylinder may have a height corresponding to a thickness of the balance weight such that the oil-separator avoids the balance weight. For example, the oil-separator may be extended without being limited by the balance weight, and the oil-separator may be prevented from being coupled to the balance weight.

In some implementations, the oil-separator may be seated on or coupled to the balance weight for a stability in a state of being coupled to the rotation shaft.

The oil-separator may further include a centrifugal separator that provides a centrifugal force to the oil and the refrigerant, and the centrifugal separator may extend from the coupler. The centrifugal separator may have a diameter larger than that of the coupler.

The centrifugal separator may extend from the coupler toward an inner wall of the compressor casing beyond the balance weight. In addition, the diameter of the centrifugal separator may be extended beyond the rotor, so that a centrifugation efficiency may be maximized. This is because the closer the distance between the outer circumferential surface of the centrifugal separator and the casing is, the greater the centrifugation efficiency.

In addition, because the centrifugal separator is spaced apart from the rotor by a height of the coupler, the oil and the refrigerant ascending through the rotor may be prevented from directly colliding with the centrifugal separator. That is, the centrifugal separator may reduce a passage resistance applied to the oil and the refrigerant.

However, the diameter of the coupler may be smaller than a diameter of the rotor to minimize a rotational inertia or a moment of inertia. Therefore, the oil-separator may be formed in two steps of the centrifugal separator and the coupler. Furthermore, the centrifugal separator may also be formed to be stepped in multiple steps, and the diameter thereof may increase toward the discharge part.

The centrifugal separator may be formed in a cup shape, and a discharge hole or a discharge slit may be defined in an outer circumferential surface thereof to discharge the collected oil. The discharge hole may be defined adjacent to the coupler to prevent the oil from remaining.

In some implementations, the centrifugal separator may be formed in a plate shape. This is because the plate shape has a smaller moment of inertia than the cup shape, which increases an efficiency of the compressor. However, the centrifugal separator may further include a vane that provides a centrifugal force to the oil or discharges the collected oil. The vane may include a plurality of vanes radially extending from the coupler to an outer circumferential surface of the centrifugal separator.

In some implementations, the centrifugal separator may be formed in the cup shape, and a vane extending radially may be installed therein. In this case, discharge of the oil collected in the cup may be accelerated.

The vane may extend to be inclined on the centrifugal separator, or may extend to be inclined or curved in a direction corresponding to the rotation direction. In addition, the vane may be disposed such that a radius of curvature thereof may vary toward the outer circumferential surface of the centrifugal separator from the coupler.

In addition, even when the centrifugal separator is formed in the cup shape, a portion of an outer circumferential surface thereof may be cut in a height direction, and a portion of the outer circumferential surface thereof may be penetrated. This may lead to the oil collected in the cut or penetrated portion to be discharged back into an oil storage space of the casing.

According to one aspect of the subject matter described in this application, a compressor includes: a casing that is configured to accommodate refrigerant and that defines a reservoir space configured to store oil, the casing including a discharge part disposed at a side of the casing and configured to discharge the refrigerant, a drive unit including a stator coupled to an inner circumferential surface of the casing and configured to generate a rotating magnetic field and a rotor accommodated in the stator and configured to rotate relative to the stator based on the rotating magnetic field, a rotation shaft coupled to the rotor and configured to be rotated by the rotor, a compression unit that is coupled to the rotation shaft, that is lubricated with the oil, and that is configured to compress and discharge the refrigerant, and an oil-separator that is disposed between the discharge part and the drive unit and that is configured to separate the oil from the refrigerant and guide the refrigerant to the discharge part. The oil-separator includes a centrifugal separator that is configured to rotate together with the rotation shaft and that is configured to generate a centrifugal force to separate the oil from the refrigerant, and a coupler that is coupled to the rotor or the rotation shaft and that is configured to rotate the centrifugal separator based on rotation of the rotating shaft.

Implementations according to this aspect may include one or more of the following features. For example, the coupler and the rotation shaft may be coaxial. In some implementations, the compressor may further include a balancer that is spaced apart from the coupler, that is coupled to the rotor, and that is configured to compensate for eccentricity of the rotation shaft. In some implementations, the oil-separator may further include a fastening member that couples the coupler to the rotation shaft, and the coupler may include a circumferential body that extends from the centrifugal separator and that receives the fastening member and a coupling body that extends radially inward from the circumferential body toward the rotation shaft.

In some examples, the fastening member may include a fastening part that passes through the coupler and that is coupled to the rotation shaft, and a fixing member coupled to the fastening part and configured to restrict rotation of the fastening member relative to the circumferential body. In some examples, a top surface of the coupler may be flush with a top surface of the balancer.

In some implementations, the centrifugal separator may extend from the coupler and be seated on an end of the balancer. In some implementations, the centrifugal separator may further extend radially outward relative to an end of the balancer.

According to another aspect, a compressor includes: a casing that accommodates refrigerant and that defines a reservoir space configured to store oil, the casing including a discharge part disposed at a side of the casing and configured to discharge the refrigerant; a drive unit including a stator coupled to an inner circumferential surface of the casing and configured to generate a rotating magnetic field, and a rotor accommodated in the stator and configured to rotate relative to the stator based on the rotating magnetic field; a rotation shaft coupled to the rotor and configured to be rotated by the rotor; a compression unit that is coupled to the rotation shaft, that is lubricated with the oil, and that is configured to compress and discharge the refrigerant; and an oil-separator that is disposed between the discharge part and the drive unit and that is configured to separate the oil from the refrigerant and guide the refrigerant to the discharge part. The oil-separator includes a coupler coupled to the rotation shaft or the rotor, and a centrifugal separator that is coupled to or extends from the coupler and that is configured to generate a centrifugal force to separate the oil from the refrigerant, the centrifugal separator including a rotating body that has a diameter greater than a diameter of the rotor and that is configured to generate the centrifugal force.

Implementations according to this aspect may include one or more of the following features. For example, the rotating body may extend from an outer circumferential surface of the coupler, and an outer circumferential surface of the rotating body may be located between an outer circumferential surface of the rotor and an inner circumferential surface of the stator. In some examples, a diameter of the coupler may be less than a diameter of the rotor.

In some implementations, the centrifugal separator may further include an extended body that extends from the rotating body toward the discharge part and that is configured to receive the oil separated from the refrigerant. In some examples, a diameter of the extended body may increase as the extended body extends from the rotating body toward the discharge part.

According to another aspect, a compressor includes: a casing that accommodates refrigerant and that defines a reservoir space configured to store oil, the casing including a discharge part disposed at a side of the casing and configured to discharge the refrigerant; a drive unit including a stator coupled to an inner circumferential surface of the casing and configured to generate a rotating magnetic field, and a rotor accommodated in the stator and configured to rotate relative to the stator based on the rotating magnetic field; a rotation shaft coupled to the rotor and configured to be rotated by the rotor; a compression unit that is coupled to the rotation shaft, that is lubricated with the oil, and that is configured to compress and discharge the refrigerant; and an oil-separator that is disposed between the discharge part and the drive unit and that is configured to separate the oil from the refrigerant and guide the refrigerant to the discharge part. The oil-separator includes a coupler that is coupled to the rotation shaft or the rotor, and a centrifugal separator that extends from the coupler, that is configured to generate a centrifugal force to separate the oil from the refrigerant, and that defines a discharge opening configured to discharge the oil from the centrifugal separator.

Implementations according to this aspect may include one or more of the following features. For example, the centrifugal separator may include: a rotating body that extends from the coupler, where a diameter of the rotating body is greater than a diameter of the coupler, and an extended body that extends from the rotating body toward the discharge part. The discharge opening may include a discharge slit that is cut along a portion of the extended body and that extends toward the discharge part.

In some implementations, the centrifugal separator may include a rotating body that extends from the coupler, a diameter of the rotating body being greater than a diameter of the coupler, and an extended body that extends from the rotating body toward the discharge part. The discharge opening may include a discharge hole that passes through the extended body. In some examples, the discharge hole may be disposed closer to the rotating body and to an end of the extended body.

In some implementations, the discharge hole may extend along a circumferential surface of the extended body, and a width of the discharge hole in a circumferential direction of the extended body may be greater than a height of the discharge hole in an axial direction of the extended body.

According to another aspect, a compressor includes: a casing that accommodates refrigerant and that defines a reservoir space configured to store oil, the casing including a discharge part disposed at a side of the casing and configured to discharge the refrigerant; a rotor disposed in the casing; a rotation shaft coupled to the rotor and configured to be rotated by the rotor; a compression unit that is coupled to the rotation shaft, that is lubricated with the oil, and that is configured to compress and discharge the refrigerant; and an oil-separator that is disposed between the discharge part and the rotor and that is configured to separate the oil from the refrigerant and guide the refrigerant to the discharge part. The oil-separator includes: a coupler coupled to the rotation shaft or the rotor, a centrifugal separator that extends from the coupler and that is configured to generate a centrifugal force to separate the oil from the refrigerant, and an extended vane that extends from the coupler toward an outer circumferential surface of the centrifugal separator.

Implementations according to this aspect may include one or more of the following features. For example, the extended vane may have a first end disposed on an outer circumferential surface of the coupler and a second end disposed on the outer circumferential surface of the centrifugal separator. In some examples, the extended vane may be inclined with respect to a radial direction of the rotation shaft. In some examples, the extended vane may be curved from the coupler to the outer circumferential surface of the centrifugal separator. In some examples, the extended vane may protrude from a surface of the centrifugal separator toward the discharge part.

In some implementations, the extended vane may include: a first curved portion that extends from an outer circumferential surface of the coupler, a radius of curvature of the first curved portion being different from a radius of curvature of the outer circumferential surface of the centrifugal separator; and a second curved portion that extends from the first curved portion to the outer circumferential surface of the centrifugal separator, a radius of curvature of the second curved portion being equal to the radius of curvature of the outer circumferential surface of the centrifugal separator.

The features of the above-described implantations may be combined with other implementations as long as they are not contradictory or exclusive to each other.

Effects are as follows but are limited thereto.

In some implementations, the oil-separator that uses the centrifugal force to separate the oil from the refrigerant may be directly connected to the rotor or the rotation shaft to suppress the occurrence of vibration.

In some implementations, the center of rotation of the oil-separator may be coupled to the rotation shaft.

In some implementations, the both ends or the both sides of the oil-separator may be coupled to the rotor about the center of rotation thereof.

In some implementations, the oil-separator may be coupled to the rotation shaft or the rotor even when the portion of the oil-separator is disposed at the free end of the balancer.

In some implementations, the oil-separator may rotate around the center of rotation but is prevented from orbiting.

In some implementations, the diameter of the oil-separator may be expended such that the oil-separator is extended beyond the outer circumferential surface of the balancer that compensates for the eccentricity of the drive unit and the outer circumferential surface of the rotor, thereby increasing the centrifugal efficiency.

In some implementations, the compressor may immediately discharge the oil collected in the oil-separator providing the centrifugal force out of the oil-separator using the centrifugal force.

In some implementations, the compressor may provide a stronger centrifugal force to the refrigerant or the oil at the same volume of the oil-separator itself.

In some implementations, the compressor may accommodate or shield the outer circumferential surface of the fastening member coupling the oil-separator with the balancer to prevent separation of the deformation of the fastening member.

Effects are not limited to the above effects. Those skilled in the art may readily derive various effects from various configurations.

DETAILED DESCRIPTIONS

For simplicity and clarity of illustration, elements in the figures are not necessarily drawn to scale. The same reference numbers in different figures denote the same or similar elements, and as such perform similar functionality. Furthermore, in the following detailed description, numerous specific details are set forth in order to provide a thorough understanding. However, it will be understood that the present disclosure may be practiced without these specific details. In other instances, well-known methods, procedures, components, and circuits have not been described in detail so as not to unnecessarily obscure aspects.

Examples of various implementations are illustrated and described further below. It will be understood that the description herein is not intended to limit the claims to the specific implementations described. On the contrary, it is intended to cover alternatives, modifications, and equivalents as may be included within the spirit and scope as defined by the appended claims.

Figure 1A:
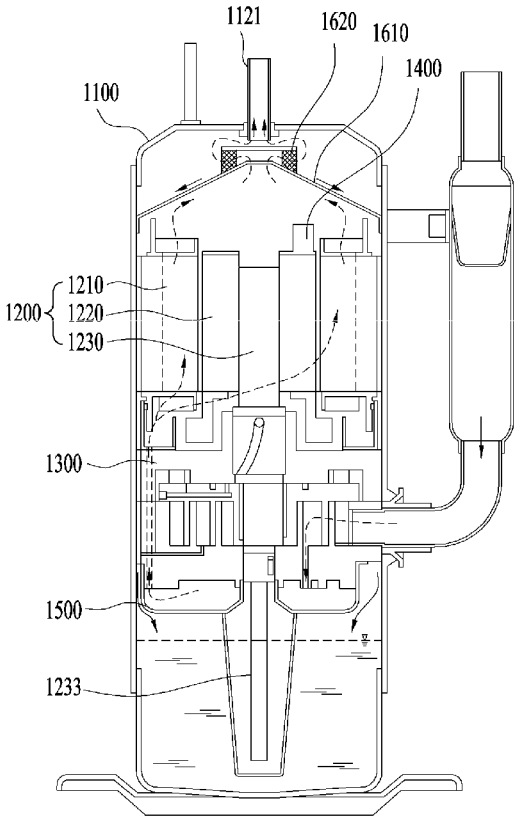
RELATED ART FIG 1A
FIGS. 1A and 1B illustrate example compressors in related art.
Figure 1B:
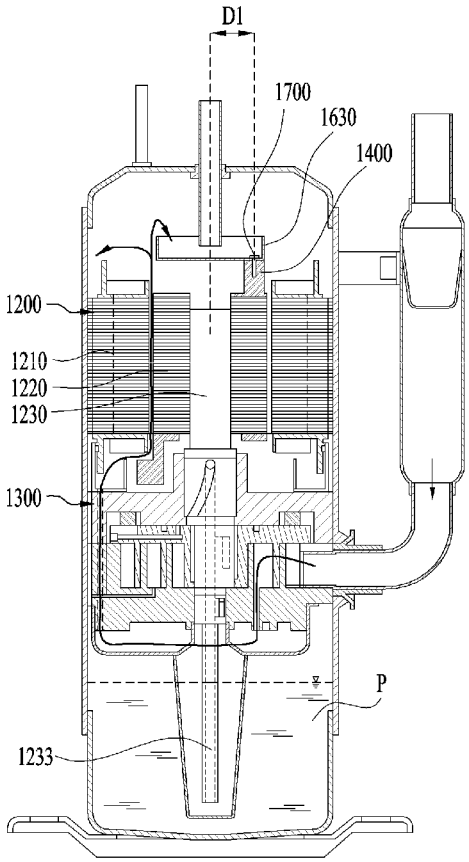
Figure 2A:
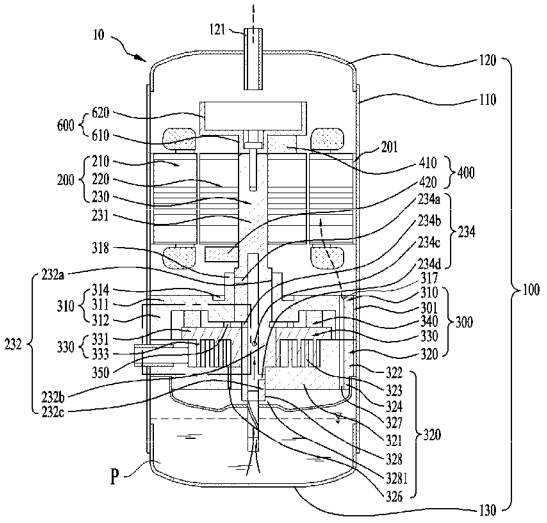
FIGS. 2A and 2B illustrate an example of a compressor.
Figure 2B:
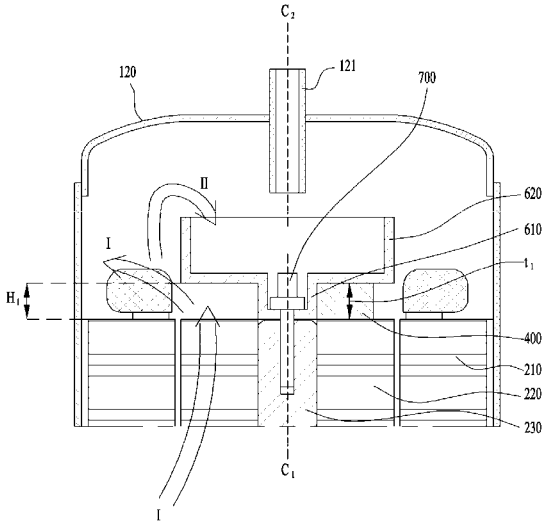

FIGS. 2A and 2B illustrate an example of a compressor according to the present disclosure.

Referring to FIG. 2A, a scroll compressor 10 according to an implementation may include a casing 100 having therein a space in which fluid is stored or flows, a drive unit 200 coupled to an inner circumferential surface of the casing 100 to rotate a rotation shaft 230, and a compression unit 300 coupled to the rotation shaft 230 inside the casing and compressing the fluid.

Specifically, the casing 100 may include a discharge part 121 through which refrigerant is discharged at one side. The casing 100 may include a receiving shell 110 provided in a cylindrical shape to receive the drive unit 200 and the compression unit 300 therein, a discharge shell 120 coupled to one end of the receiving shell 110 and having the discharge part 121, and a sealing shell 130 coupled to the other end of the receiving shell 110 to seal the receiving shell 110.

The drive unit 200 may include a motor. For instance, the drive unit 200 may include a stator 210 for generating a rotating magnetic field, and a rotor 220 disposed to rotate by the rotating magnetic field. The rotation shaft 230 may be coupled to the rotor 220 to be rotated together with the rotor 220.

The stator 210 has a plurality of slots defined in an inner circumferential surface thereof along a circumferential direction and a coil is wound around the plurality of slots. Further, the stator 210 may be fixed to an inner circumferential surface of the receiving shell 110. A permanent magnet may be coupled to the rotor 220, and the rotor 220 may be rotatably coupled within the stator 210 to generate rotational power. The rotation shaft 230 may be pressed into and coupled to a center of the rotor 220.

The compression unit 300 may include a fixed scroll 320 coupled to the receiving shell 110 and disposed in a direction away from the discharge part 121 with respect to the drive unit 200, an orbiting scroll 330 coupled to the rotation shaft 230 and engaged with the fixed scroll 320 to define a compression chamber, and a main frame 310 accommodating the orbiting scroll 330 therein and seated on the fixed scroll 320 to form an outer shape of the compression unit 300.

For example, the scroll compressor 10 has the drive unit 200 disposed between the discharge part 121 and the compression unit 300. In other words, the drive unit 200 may be disposed at one side of the discharge part 121, and the compression unit 300 may be disposed in a direction away from the discharge part 121 with respect to the drive unit 200. For example, when the discharge part 121 is disposed on the casing 100, the compression unit 300 may be disposed below the drive unit 200, and the drive unit 200 may be disposed between the discharge part 121 and the compression unit 300. In some cases, the compression unit 300 may include a compressor including scrolls that are engaged to each other and that are orbit relative to each other to compress refrigerant received between the scrolls.

In some implementations, when oil is stored in an oil storage space p of the casing 100, the oil may be supplied directly to the compression unit 300 without passing through the drive unit 200. In addition, since the rotation shaft 230 is coupled to and supported by the compression unit 300, a lower frame for rotatably supporting the rotation shaft may be omitted.

In some implementations, the lower scroll compressor 10 may be provided such that the rotation shaft 230 penetrates not only the orbiting scroll 330 but also the fixed scroll 320 to be in face contact with both the orbiting scroll 330 and the fixed scroll 320.

For example, an inflow force generated when the fluid such as the refrigerant is flowed into the compression unit 300, a gas force generated when the refrigerant is compressed in the compression unit 300, and a reaction force for supporting the same may be directly exerted on the rotation shaft 230. Accordingly, the inflow force, the gas force, and the reaction force may be exerted to a point of application of the rotation shaft 230. For example, since an upsetting moment does not act on the orbiting scroll 320 coupled to the rotation shaft 230, tilting or upsetting of the orbiting scroll may be blocked. In other words, tilting in an axial direction of the tilting may be attenuated or prevented, and the upsetting moment of the orbiting scroll 330 may also be attenuated or suppressed. For example, noise and vibration generated in the lower scroll compressor 10 may be blocked.

In addition, the fixed scroll 320 is in face contact with and supports the rotation shaft 230, so that durability of the rotation shaft 230 may be reinforced even when the inflow force and the gas force act on the rotation shaft 230.

In addition, a back pressure generated while the refrigerant is discharged to outside is also partially absorbed or supported by the rotation shaft 230, so that a force (normal force) in which the orbiting scroll 330 and the fixed scroll 320 become excessively close to each other in the axial direction may be reduced. For example, a friction force between the orbiting scroll 330 and the fixed scroll 320 may be greatly reduced.

For example, the compressor 10 attenuates the tilting in the axial direction and the upsetting moment of the orbiting scroll 330 inside the compression unit 300 and reduces the frictional force of the orbiting scroll, thereby increasing an efficiency and a reliability of the compression unit 300.

In some implementations, the main frame 310 of the compression unit 300 may include a main end plate 311 provided at one side of the drive unit 200 or at a lower portion of the drive unit 200, a main side plate 312 extending in a direction farther away from the drive unit 200 from an inner circumferential surface of the main end plate 311 and seated on the fixed scroll 330, and a main shaft receiving portion 318 extending from the main end plate 311 to rotatably support the rotation shaft 230.

A main hole 317 for guiding the refrigerant discharged from the fixed scroll 320 to the discharge part 121 may be further defined in the main end plate 311 or the main side plate 312.

The main end plate 311 may further include an oil pocket 314 that is engraved in an outer face of the main shaft receiving portion 318. The oil pocket 314 may be defined in an annular shape, and may be defined to be eccentric to the main shaft receiving portion 318. When the oil stored in the sealing shell 130 is transferred through the rotation shaft 230 or the like, the oil pocket 314 may be defined such that the oil is supplied to a portion where the fixed scroll 320 and the orbiting scroll 330 are engaged with each other.

The fixed scroll 320 may include a fixed end plate 321 coupled to the receiving shell 110 in a direction away from the drive unit 200 with respect to the main end plate 311 to form the other face of the compression unit 300, a fixed side plate 322 extending from the fixed end plate 321 to the discharge part 121 to be in contact with the main side plate 312, and a fixed wrap 323 disposed on an inner circumferential surface of the fixed side plate 322 to define the compression chamber in which the refrigerant is compressed.

In some implementations, the fixed scroll 320 may include a fixed through-hole 328 defined to penetrate the rotation shaft 230, and a fixed shaft receiving portion 3281 extending from the fixed through-hole 328 such that the rotation shaft is rotatably supported. The fixed shaft receiving portion 3331 may be disposed at a center of the fixed end plate 321.

A thickness of the fixed end plate 321 may be equal to a thickness of the fixed shaft receiving portion 3381. In this case, the fixed shaft receiving portion 3281 may be inserted into the fixed through-hole 328 instead of protruding from the fixed end plate 321.

The fixed side plate 322 may include an inflow hole 325 defined therein for flowing the refrigerant into the fixed wrap 323, and the fixed end plate 321 may include discharge hole 326 defined therein through which the refrigerant is discharged. The discharge hole 326 may be defined in a center direction of the fixed wrap 323, or may be spaced apart from the fixed shaft receiving portion 3281 to avoid interference with the fixed shaft receiving portion 3281, or the discharge hole 326 may include a plurality of discharge holes.

The orbiting scroll 330 may include an orbiting end plate 331 disposed between the main frame 310 and the fixed scroll 320, and an orbiting wrap 333 disposed below the orbiting end plate to define the compression chamber together with the fixed wrap 323 in the orbiting end plate.

The orbiting scroll 330 may further include an orbiting through-hole 338 defined through the orbiting end plate 331 to rotatably couple the rotation shaft 230.

The rotation shaft 230 may be disposed such that a portion thereof coupled to the orbiting through-hole 338 is eccentric. Thus, when the rotation shaft 230 is rotated, the orbiting scroll 330 moves in a state of being engaged with the fixed wrap 323 of the fixed scroll 320 to compress the refrigerant.

Specifically, the rotation shaft 230 may include a main shaft 231 coupled to the drive unit 200 and rotating, and a bearing portion 232 connected to the main shaft 231 and rotatably coupled to the compression unit 300. The bearing portion 232 may be included as a member separate from the main shaft 231, and may accommodate the main shaft 231 therein, or may be integrated with the main shaft 231.

The bearing portion 232 may include a main bearing portion 232*c* inserted into the main shaft receiving portion 318 of the main frame 310 and rotatably supported, a fixed bearing portion 232*a* inserted into the fixed shaft receiving portion 3281 of the fixed scroll 320 and rotatably supported, and an eccentric shaft 232*b* disposed between the main bearing portion 232*c* and the fixed bearing portion 232*a*, and inserted into the orbiting through-hole 338 of the orbiting scroll 330 and rotatably supported.

In some examples, the main bearing portion 232*c* and the fixed bearing portion 232*a* may be coaxial to have the same axis center, and the eccentric shaft 232*b* may be formed such that a center of gravity thereof is radially eccentric with respect to the main bearing portion 232*c* or the fixed bearing portion 232*a*. In addition, the eccentric shaft 232*b* may have an outer diameter greater than an outer diameter of the main bearing portion 232*c* or an outer diameter of the fixed bearing portion 232*a*. As such, the eccentric shaft 232*b* may provide a force to compress the refrigerant while orbiting the orbiting scroll 330 when the bearing portion 232 rotates, and the orbiting scroll 330 may be disposed to regularly orbit the fixed scroll 320 by the eccentric shaft 232*b*.

However, in order to prevent the orbiting scroll 320 from rotating, the compressor 10 may further include an Oldham's ring 340 (or Oldham ring) coupled to an upper portion of the orbiting scroll 320. The Oldham's ring 340 may be disposed between the orbiting scroll 330 and the main frame 310 to be in contact with both the orbiting scroll 330 and the main frame 310. The Oldham's ring 340 may be disposed to linearly move in four directions of front, rear, left, and right directions to prevent the rotation of the orbiting scroll 320.

In some implementations, the rotation shaft 230 may be disposed to completely pass through the fixed scroll 320 to protrude out of the compression unit 300. For example, the rotation shaft 230 may be in direct contact with outside of the compression unit 300 and the oil stored in the sealing shell 130. The rotation shaft 230 may supply the oil into the compression unit 300 while rotating.

The oil may be supplied to the compression unit 300 through the rotation shaft 230. An oil supply passage 234 for supplying the oil to an outer circumferential surface of the main bearing portion 232*c*, an outer circumferential surface of the fixed bearing portion 232*a*, and an outer circumferential surface of the eccentric shaft 232*b* may be formed at or inside the rotation shaft 230.

In addition, a plurality of oil supply holes 234*a*, 234*b*, 234*c*, and 234*d* may be defined in the oil supply passage 234. Specifically, the oil supply hole may include a first oil supply hole 234*a*, a second oil supply hole 234*b*, a third oil supply hole 234*c*, and a fourth oil supply hole 234*d*. First, the first oil supply hole 234*a* may be defined to penetrate through the outer circumferential surface of the main bearing portion 232*c*.

The first oil supply hole 234*a* may be defined to penetrate into the outer circumferential surface of the main bearing portion 232*c* in the oil supply passage 234. In addition, the first oil supply hole 234*a* may be defined to, for example, penetrate an upper portion of the outer circumferential surface of the main bearing portion 232*c*, but is not limited thereto. That is, the first oil supply hole 234*a* may be defined to penetrate a lower portion of the outer circumferential surface of the main bearing portion 232*c*. For reference, unlike as shown in the drawing, the first oil supply hole 234*a* may include a plurality of holes. In addition, when the first oil supply hole 234*a* includes the plurality of holes, the plurality of holes may be defined only in the upper portion or only in the lower portion of the outer circumferential surface of the main bearing portion 232*c*, or may be defined in both the upper and lower portions of the outer circumferential surface of the main bearing portion 232*c*.

In addition, the rotation shaft 230 may include an oil feeder 233 disposed to pass through a muffler 500 to be described later to be in contact with the stored oil of the casing 100. The oil feeder 233 may include an extension shaft 233*a* passing through the muffler 500 and in contact with the oil, and a spiral groove 233*b* spirally defined in an outer circumferential surface of the extension shaft 233*a* and in communication with the oil supply passage 234.

Thus, when the rotation shaft 230 is rotated, due to the spiral groove 233*b*, a viscosity of the oil, and a pressure difference between a high pressure region S1 and an intermediate pressure region V1 inside the compression unit 300, the oil rises through the oil feeder 233 and the oil supply passage 234 and is discharged into the plurality of oil supply holes. The oil discharged through the plurality of oil supply holes 234*a*, 234*b*, 234*c*, and 234*d* not only maintains an airtight state by forming an oil film between the fixed scroll 250 and the orbiting scroll 240, but also absorbs frictional heat generated at friction portions between the components of the compression unit 300 and discharge the heat.

The oil guided along the rotation shaft 230 and supplied through the first oil supply hole 234*a* may lubricate the main frame 310 and the rotation shaft 230. In addition, the oil may be discharged through the second oil supply hole 234*b* and supplied to a top face of the orbiting scroll 240, and the oil supplied to the top face of the orbiting scroll 240 may be guided to the intermediate pressure region through the pocket groove 314. For reference, the oil discharged not only through the second oil supply hole 234*b* but also through the first oil supply hole 234*a* or the third oil supply hole 234*c* may be supplied to the pocket groove 314.

In some implementations, the oil guided along the rotation shaft 230 may be supplied to the Oldham's ring 340 and the fixed side plate 322 of the fixed scroll 320 installed between the orbiting scroll 240 and the main frame 310. Thus, wear of the fixed side plate 322 of the fixed scroll 320 and the Oldham's ring 340 may be reduced. In addition, the oil supplied to the third oil supply hole 234*c* is supplied to the compression chamber to not only reduce wear due to friction between the orbiting scroll 330 and the fixed scroll 320, but also form the oil film and discharge the heat, thereby improving a compression efficiency.

Although a centrifugal oil supply structure in which the lower scroll compressor 10 uses the rotation of the rotation shaft 230 to supply the oil to the bearing has been described, the centrifugal oil supply structure is merely an example. Further, a differential pressure supply structure for supplying oil using a pressure difference inside the compression unit 300 and a forced oil supply structure for supplying oil through a toroid pump, and the like may also be applied.

In some implementations, the compressed refrigerant is discharged to the discharge hole 326 along a space defined by the fixed wrap 323 and the orbiting wrap 333. The discharge hole 326 may be more advantageously disposed toward the discharge part 121. This is because the refrigerant discharged from the discharge hole 326 is most advantageously delivered to the discharge part 121 without a large change in a flow direction.

However, because of structural characteristics that the compression unit 300 is provided in a direction away from the discharge part 121 with respect to the drive unit 200, and that the fixed scroll 320 should be disposed at an outermost portion of the compression unit 300, the discharge hole 326 is disposed to spray the refrigerant in a direction opposite to the discharge part 121.

In other words, the discharge hole 326 is defined to spray the refrigerant in a direction away from the discharge part 121 with respect to the fixed end plate 321. Therefore, when the refrigerant is sprayed into the discharge hole 326 as it is, the refrigerant may not be smoothly discharged to the discharge part 121, and when the oil is stored in the sealing shell 130, the refrigerant may collide with the oil and be cooled or mixed.

In order to prevent this, the compressor 10 may further include the muffler 500 coupled to an outermost portion of the fixed scroll 320 and providing a space for guiding the refrigerant to the discharge part 121.

The muffler 500 may be disposed to seal one face disposed in a direction farther away from the discharge part 121 of the fixed scroll 320 to guide the refrigerant discharged from the fixed scroll 320 to the discharge part 121.

The muffler 500 may include a coupling body 520 coupled to the fixed scroll 320 and a receiving body 510 extending from the coupling body 520 to define sealed space therein. Thus, the refrigerant sprayed from the discharge hole 326 may be discharged to the discharge part 121 by switching the flow direction along the sealed space defined by the muffler 500.

Further, since the fixed scroll 320 is coupled to the receiving shell 110, the refrigerant may be restricted from flowing to the discharge part 121 by being interrupted by the fixed scroll 320. Therefore, the fixed scroll 320 may further include a bypass hole 327 defined therein allowing the refrigerant penetrated the fixed end plate 321 to pass through the fixed scroll 320. The bypass hole 327 may be disposed to be in communication with the main hole 317. Thus, the refrigerant may pass through the compression unit 300, pass the drive unit 200, and be discharged to the discharge part 121.

The more the refrigerant flows inward from an outer circumferential surface of the fixed wrap 323, the higher the pressure compressing the refrigerant. Thus, an interior of the fixed wrap 323 and an interior of the orbiting wrap 333 may maintain in a high pressure state. Accordingly, a discharge pressure is exerted to a rear face of the orbiting scroll as it is, and the back pressure is exerted toward the fixed scroll in the orbiting scroll in reaction. The compressor 10 may further include a back pressure seal 350 that concentrates the back pressure on a portion where the orbiting scroll 320 and the rotation shaft 230 are coupled to each other, thereby preventing leakage between the orbiting wrap 333 and the fixed wrap 323.

The back pressure seal 350 is disposed in a ring shape to maintain an inner circumferential surface thereof at a high pressure, and separate an outer circumferential surface thereof at an intermediate pressure lower than the high pressure. Therefore, the back pressure is concentrated on the inner circumferential surface of the back pressure seal 350, so that the orbiting scroll 330 is in close contact with the fixed scroll 320.

In some examples, considering that the discharge hole 326 is defined to be spaced apart from the rotation shaft 230, the back pressure seal 350 may also be disposed such that a center thereof is biased toward the discharge hole 326.

In addition, due to the back pressure seal 350, the oil supplied from the first oil supply groove 234*a* may be supplied to the inner circumferential surface of the back pressure seal 350. Therefore, the oil may lubricate a contact face between the main scroll and the orbiting scroll. Further, the oil supplied to the inner circumferential surface of the back pressure seal 350 may generate a back pressure for pushing the orbiting scroll 330 to the fixed scroll 320 together with a portion of the refrigerant.

As such, the compression space of the fixed wrap 323 and the orbiting wrap 333 may be divided into the high pressure region S1 inside the back pressure seal 350 and the intermediate pressure region V1 outside the back pressure seal 350 on the basis of the back pressure seal 350. In some implementations, the high pressure region S1 and the intermediate pressure region V1 may be naturally divided because the pressure is increased in a process in which the refrigerant is introduced and compressed. However, since the pressure change may occur critically due to a presence of the back pressure seal 350, the compression space may be divided by the back pressure seal 350.

In some implementations, the oil supplied to the compression unit 300, or the oil stored in the oil storage space P of the casing 100 may flow toward an upper portion of the casing 100 together with the refrigerant as the refrigerant is discharged to the discharge part 121. In some examples, because the oil is denser than the refrigerant, the oil may not be able to flow to the discharge part 121 by a centrifugal force generated by the rotor 220, and may be attached to inner walls of the discharge shell 120 and the receiving shell 110. The lower scroll compressor 10 may further include recovery passages respectively on outer circumferential surfaces of the drive unit 200 and the compression unit 300 to recover the oil attached to an inner wall of the casing 100 to the oil storage space of the casing 100 or the sealing shell 130.

The recovery passage may include a driver recovery passage 201 defined in an outer circumferential surface of the drive unit 200, a compression recovery passage 301 defined in an outer circumferential surface of the compression unit 300, and a muffler recovery passage 501 defined in an outer circumferential surface of the muffler 500.

The driver recovery passage 201 may be defined by recessing a portion of an outer circumferential surface of the stator 210 is recessed, and the compression recovery passage 301 may be defined by recessing a portion of an outer circumferential surface of the fixed scroll 320. In addition, the muffler recovery passage 501 may be defined by recessing a portion of the outer circumferential surface of the muffler. The driver recovery passage 201, the compression recovery passage 301, and the muffler recovery passage 501 may be defined in communication with each other to allow the oil to pass therethrough.

As described above, because the rotation shaft 230 has a center of gravity biased to one side due to the eccentric shaft 232*b*, during the rotation, an unbalanced eccentric moment occurs, causing an overall balance to be distorted. Accordingly, the lower scroll compressor 10 may further include a balancer 400 that may offset the eccentric moment that may occur due to the eccentric shaft 232*b*.

In some implementations, where the compression unit 300 is fixed to the casing 100, the balancer 400 may be coupled to the rotation shaft 230 itself or the rotor 220 disposed to rotate. Therefore, the balancer 400 may include a central balancer 410 disposed on a bottom of the rotor 220 or on a face f acing the compression unit 300 to offset or reduce an eccentric load of the eccentric shaft 232*b*, and an outer balancer 420 coupled to a top of the rotor 220 or the other face facing the discharge part 121 to offset an eccentric load or an eccentric moment of at least one of the eccentric shaft 232*b* and the outer balancer 420.

Because the central balancer 410 is disposed relatively close to the eccentric shaft 232*b*, the central balancer 410 may directly offset the eccentric load of the eccentric shaft 232*b*. Accordingly, the central balancer 410 may be disposed eccentrically in a direction opposite to the direction in which the eccentric shaft 232*b* is eccentric. For example, even when the rotation shaft 230 rotates at a low speed or a high speed, because a distance away from the eccentric shaft 232*b* is close, the central balancer 410 may effectively offset an eccentric force or the eccentric load generated in the eccentric shaft 232*b* almost uniformly.

The outer balancer 420 may be disposed eccentrically in a direction opposite to the direction in which the eccentric shaft 232*b* is eccentric. However, the outer balancer 420 may be eccentrically disposed in a direction corresponding to the eccentric shaft 232*b* to partially offset the eccentric load generated by the central balancer 410.

For example, the central balancer 410 and the outer balancer 420 may offset the eccentric moment generated by the eccentric shaft 232*b* to assist the rotation shaft 230 to rotate stably.

In some implementations, the compressor 10 may include an oil-separator 600 disposed to separate the oil from the refrigerant supplied to a space between the drive unit 200 and the discharge part 121.

The oil-separator 600 may be coupled to the drive unit 200 and rotate together with the rotation shaft 230 when the rotation shaft 230 rotates. Specifically, the oil-separator 800 may be coupled to the rotation shaft 230 such that a center of rotation C2 of the oil-separator 600 may be the same as a center of rotation C1 of the rotation shaft 230.

Because the oil-separator 600 rotates at a high speed when the rotation shaft 230 rotates, the oil-separator 600 may provide a strong centrifugal force to refrigerant and oil around the oil-separator 600. Since the refrigerant has a density relatively smaller than that of the oil, the refrigerant may not be significantly affected by the centrifugal force generated in the oil-separator 600. That is, because the centrifugal force acting on the refrigerant is smaller than a pressure difference between inside and outside of the discharge part 121, the refrigerant may be discharged to the discharge part 121 without being affected by the oil-separator 600 (II direction). However, the oil has a higher density than the refrigerant, and oil particles are easy to grow into a large droplet when colliding with each other. Therefore, because the oil is more affected by the centrifugal force generated in the oil-separator 600 than the refrigerant, in the vicinity of the oil-separator 600, the oil particles collide with the casing 100 while colliding with each other to grow into the droplet, so that the oil may be recovered into the oil storage space through the recovery passage (I direction).

In some implementations, when the density of the oil passed through the oil-separator 600 becomes larger, the oil may not be discharged to the discharge part 121 and may be stored in the oil-separator 600. The stored oil may be discharged again to the inner wall of the casing 100 by the centrifugal force of the oil-separator 600 and recovered.

Referring to FIG. 2B, in the compressor of an implementation, the oil-separator 600 may include a centrifugal separator 620 that rotates together with the rotation shaft 230 and provides a centrifugal force for separating the oil from the refrigerant, and a coupler 610 disposed to rotate the centrifugal separator 620 together with the rotation shaft.

The coupler 610 may be directly coupled to the rotation shaft 230 or coupled to the rotor 220 to rotate together with the rotation shaft 230. In addition, the coupler 610 may be coupled to at least one of the rotation shaft 230 and the rotor 220 through a separate fastening member 700. In addition, the coupler 610 may be coupled to an inner circumferential surface of the rotor 220 or an exposed face of the rotor 220 facing the discharge part 121.

In addition, the coupler 610 may be coupled to a portion of the inner circumferential surface of the rotor. In some examples, a plurality of portions, where the coupler 610 and the rotor are coupled with each other, may be spaced apart from each other. In some examples, the portions, where the coupler 610 and the rotor are coupled with each other, may be non-eccentrically distributed without being eccentric to one side of the rotation shaft. This is to prevent the oil-separator 600 from excessively vibrating due to excessive presence of a region in which the oil-separator is released in the oil-separator 600. For example, the coupler 610 may be coupled to each of symmetrical portions of the inner circumferential surface of the rotor 220 with respect to the rotation shaft 230.

Regardless of which portion of the rotation shaft 230 or of the rotor 220 to which the coupler 610 is coupled, the coupler 610 may be coupled such that the rotation center thereof is located at the rotation shaft 230. In addition, the coupler 610 may be disposed such that at least one end thereof is entirely coupled to the rotation shaft 230 or in contact with the rotor 220. For example, a portion of the coupler 610 may be prevented from vibrating apart from the drive unit 200. Specifically, a center of rotation of the coupler 610 and the center of rotation of the rotation shaft 230 may be coincident with each other.

Therefore, the coupler 610 may be prevented from vibrating like a cantilever as much as possible even when an external force or an impact is exerted thereto. Further, even when the coupler 610 rotates at a high speed, the coupler 610 may be prevented from tilting or vibrating as much as possible.

The coupler 610 is not coupled only to the balancer 400. In addition, the coupler 610 may be coupled to the balancer 400. In other words, the compressor of the implementation may prevent that only a portion eccentric from the center of rotation of the coupler 610 to one side is coupled to the balancer 400.

In some examples, an outer circumferential surface of the coupler 610 may be in contact with an inner circumferential surface of the balancer 400. In addition, the coupler 610 may be disposed inside the balancer 400 so as to be spaced apart from the inner circumferential surface of the balancer 400. However, the outer circumferential surface of the coupler 610 may not extend to be larger than the balancer 400. Thus, a diameter of the coupler 610 may be smaller than a distance from the rotation shaft 230 to the inner circumferential surface of the balancer 400. Therefore, a moment of inertia of the coupler 610 itself may be minimized.

The coupler 610 may be disposed in a cylindrical shape to define a space therein, or may be disposed in a pillar shape. However, in order to minimize the moment of inertia and a passage resistance, it may be advantageous that a cross section of the coupler 610 is circular.

In some implementations, the fastening member 700 may pass through the coupler 610 to be coupled to the rotation shaft 230 or to the rotor 220. In some examples, the coupler 610 may be disposed to accommodate the fastening member 700 therein. For example, the fastening member 700 may be prevented from being in contact with the refrigerant or the oil supplied toward the discharge part 121, thereby preventing deformation or modification of the fastening member 700. In addition, transmission of excessive pressure, vibration, or impact to the fastening member 700 may be blocked as much as possible. Furthermore, the fastening member 700 may prevent the oil or the refrigerant from interfering with the flow of the fastening member 700.

For example, the coupler 610 accommodates the fastening member 700 therein, so that the oil-separator 600 and the drive unit 200 may be stably coupled with each other, and an efficiency of the compressor may also be improved. The fastening member 700 may be disposed not to protrude further toward the discharge part 121 than the coupler 610, and may be disposed to shield the inner circumferential surface of the coupler 610.

In some implementations, the centrifugal separator 620 may extend from the other end or the outer circumferential surface of the coupler 610 to rotate together with the coupler 610. In some implementations, the centrifugal separator 620 may be coupled to a free end of the coupler 610.

The centrifugal separator 620 provides a centrifugal force to the refrigerant and the oil to separate the oil having relatively greater density, weight, and particle diameter from the refrigerant. The centrifugal separator 620 may have a larger diameter than the coupler 610. For example, the centrifugal separator 620 may exert the centrifugal force stronger than that from the coupler 610 on the refrigerant or oil.

Referring to FIG. 2B, in some examples, a height H1 of the coupler 610 may be equal to or larger than a thickness T1 of the balancer 400. In some examples, the centrifugal separator 620 may have a larger diameter than the coupler 610 without being limited by the position or the shape of the balancer 400. The centrifugal separator 620 may be disposed closer to the discharge part 121 than the balancer 400. In some examples, the centrifugal separator 620 may be in contact with the refrigerant with a sufficient area to not only provide sufficient centrifugal force to the oil, but also guide the refrigerant separated from the oil to the discharge part 121 so as not to be mixed with the oil again. For example, a portion of the centrifugal separator 620 may be seated on a free end of the balancer 400, thereby immediately delivering various energies exerted to the centrifugal separator 620 to the drive unit 200. Therefore, a vibration resistivity and a durability of the centrifugal separator 620 may be increased.

In some implementations, the coupler 610 may be spaced toward the discharge part 121 by at least the height H1 from the rotation shaft 230, so that the centrifugal separator 620 is spaced apart from the drive unit 200 by the height of H1. Thus, even when the centrifugal separator 620 has a larger diameter than the coupler 610, the oil and the refrigerant supplied between the rotor 220 and the stator 210 or from the rotor 220 may be supplied in the I direction or the II direction without being interrupted by the centrifugal separator 620.

The diameter of the coupler 610 may be the equal to or smaller than a diameter of the rotor, and the centrifugal separator may have a diameter equal to or larger than that of the rotor. Thus, the refrigerant or the oil supplied between the rotor and the stator may be guided to the discharge part 121 without being interrupted.

In addition, because the coupler 610 is coupled to the rotation shaft 230 symmetrically around the rotation shaft 230, even when the rotation shaft 230 rotates at a high speed, the coupling therebetween may be stably maintained. In addition, the coupler 610 may be prevented from easily vibrating by the external impact or pressure. Thus, even when the oil-separator 600 is provided as a centrifugal oil separating member, the vibration or the noise may not occur or be reduced in the compressor according to an implementation, and a coupling force of the oil-separator 600 and the drive unit 200 may be strengthened.

Because the coupler 610 is not coupled only to the balancer 400, the coupler 610 may be coupled to the rotation shaft 230 such that the center of rotation thereof is the same as that of the rotation shaft 230. Therefore, a center of gravity of the coupler 610 may be present at an imaginary linear extension from the rotation shaft 230. In addition, the center of rotation of the coupler 610 may be coincident with the center of rotation of the rotation shaft 230. As such, the coupler 610 may be disposed to rotate but not to orbit.

Therefore, when the cross section of the oil-separator 600 is circular, a space or volume occupied by the oil-separator 600 may always be fixed. Therefore, even when the oil-separator 600 rotates at a high speed, passage resistances applied to the refrigerant and the oil may be almost the same when excluding a friction.

Further, because the center of rotation of the oil-separator 600 may be present on the rotation shaft or the oil-separator 600 may be non-eccentrically coupled to the rotor 220 by the coupler 610, a certain portion of the coupler 610 may be prevented from vibrating, or repeatedly spacing from or being brought into contact with the drive unit.

In addition, when the fastening member 700 passes through the coupler 610 and is coupled to the rotation shaft 230, because the centrifugal force does not act on the fastening member 700, the oil-separator 600 may be installed on the drive unit 200 and maintained more stably.

Figure 3A:
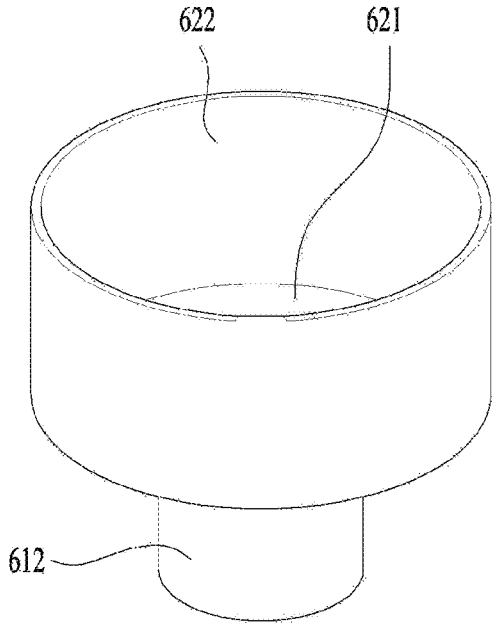
FIGS. 3A and 3B illustrate an example of a coupling structure of an oil-separator providing a centrifugal force.
Figure 3B:
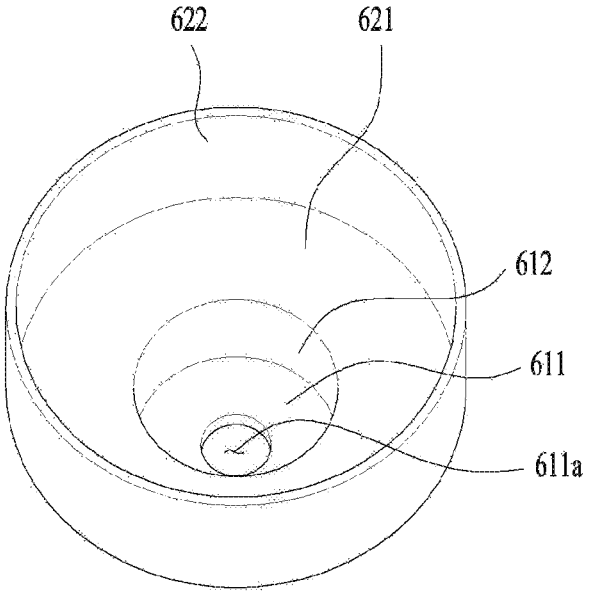

FIGS. 3A and 3B illustrate an example of a structure of the oil-separator 600.

The oil-separator 600 may include the coupler 610 coupled to the rotation shaft 230 or the rotor 2230, and the centrifugal separator 620 extending from one end of the coupler 610 and having a larger diameter than the coupler 610.

Referring to FIG. 3A, the centrifugal separator 620 may include a rotating body 621 extending from the coupler, and an extended body 622 extending toward the discharge part from the rotating body 621. An inner circumferential surface of the rotating body 621 may correspond to the outer circumferential surface of the coupler, and the rotating body 621 may be disposed as a disk to shield one end of the coupler 610.

The rotating body 621 may rotate together with the coupler 610 to generate a centrifugal force in a radial direction of the rotation shaft, and the extended body 622 may serve to extend the generated centrifugal force in a direction parallel to the rotation shaft.

The diameter of the rotating body 621 may be much larger than the diameter of the coupler 610. This is because the centrifugal force is generated in proportion to a radius of the rotating body 621. The extended body 622 may extend vertically from the rotating body 621, or may be provided to have a diameter increasing toward a free end of the rotating body 621. This is to separate the oil more from the refrigerant as the oil becomes closer to the discharge part 121, and to more smoothly discharge the oil recovered in the extended body 622 to the outside.

Referring to FIG. 3B, the coupler 610 may include a coupling body 611 formed in a cylindrical shape and able to be in contact with one end of the rotation shaft 230 or be spaced apart from one end of the rotation shaft 230 by a certain distance, and a circumferential body 612 extending from an outer circumferential surface of the coupling body 611 and accommodating the fastening member 700 therein. The coupling body 611 is disposed to shield an inner circumferential surface of one end of the circumferential body 612, and may include a coupling hole 611*a* through which the fastening member 700 may penetrate.

FIGS. 4A to 4E illustrate examples structures of the fastening member 700. For example, the fastening member 700 may include one or more bolts and one or more nuts.

Figure 4A:
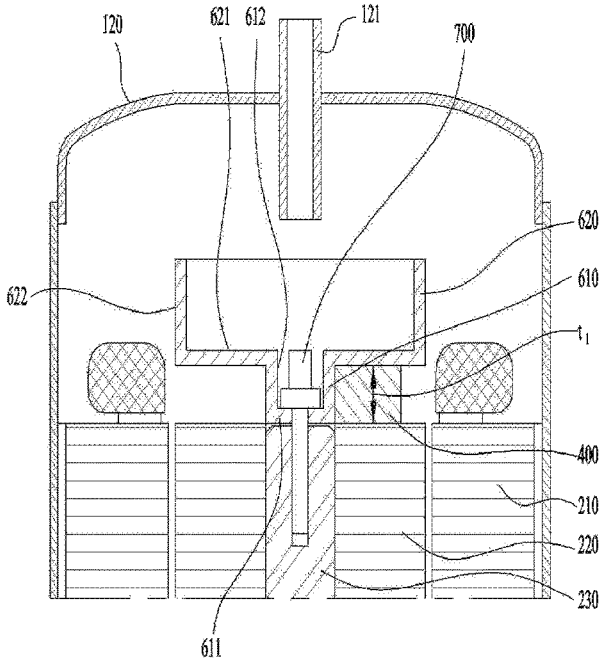
FIGS. 4A to 4E illustrate examples of the oil-separator.

Referring to FIG. 4A, the fastening member 700 may include a first fastening member 710 penetrating the coupling body 611 and coupled to the rotation shaft 230.

In some implementations, the fastening member 700 may include a first fastening member or fastening part 710 that penetrates a central portion of the coupling body 611 and that is coupled to the rotation shaft 230. For example, the first fastening member or fastening part 710 may include a bolt and the like. The rotation shaft 230 may further include a fastening groove which may be coupled to the first fastening member 710 at one end thereof.

Because the rotation shaft 230 corresponds to the center of rotation, the first fastening member 710 may stably couple the oil-separator 600 to the rotation shaft 230 even when the oil-separator 600 rotates.

In some cases, where the fastening part 710 is present at the center of rotation, there may be a risk that the fastening part 710 is released by a rotating inertial force. Thus, in some examples, the coupler 900 may further include a fixing member 720 that prevents the first fastening member 710 from rotating relative to the coupling body 611. The fixing member 720 induces the first fastening member 710 and the coupling body 611 to always rotate integrally, thereby preventing the first fastening member 710 from rotating separately and being separated from the coupling body 611.

Figure 4B:
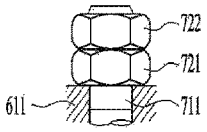

Referring to FIG. 4B, the first fastening member 710 includes a screw 711 having a screw groove in an outer circumferential surface thereof to pass through the coupling body 611 and be connected to the rotation shaft 230. The fixing member 720 may include a first nut 721 coupled to the screw 711 to couple the screw to the coupling body 611 and the rotation shaft 230, and a second nut 722 coupled to the screw 711 at one side of the first nut 721 to prevent rotation of the first nut 721.

Directions of screws respectively disposed on inner circumferential surfaces of the first nut 721 and the second nut 722 may be opposite to each other. Therefore, even when a rotational force or an inertial force acts on the screw 711, the first nut 721 and the second nut 722 may complementarily fix the position of the screw 711.

Figure 4C:
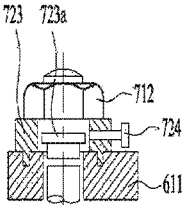

Referring to FIG. 4C, the first fastening member 710 may include a bolt 712 penetrating the coupling body 611 to be coupled to the rotation shaft 230. The fixing member 720 may include a washer 723 disposed between the bolt 712 and the coupling body 611, and a fixed pin 724 inserted into a washer hole 723*a* defined in the washer 723 to fix the bolt 712. The washer 723 may enhance an adhesion between the bolt 712 and the coupling body 611 and the fixed pin 724 may enhance a coupling force between the washer 723 and the bolt 712 to prevent the bolt 712 from rotating arbitrarily in the rotation shaft 230.

Figure 4D:
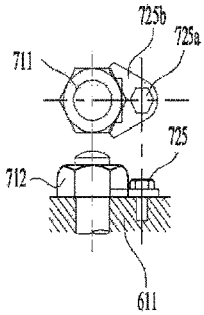

Referring to FIG. 4D, the first fastening member 710 may include the bolt 712 penetrating the coupling body 611 to be coupled the rotation shaft 230, and the fixing member 720 may include an auxiliary fixer 724 that is in close contact with an outer circumferential surface of the bolt 712 to prevent arbitrary rotation of the bolt 712.

In some examples, the auxiliary fixer 724 may include a fixed shaft 725*a* spaced apart from the bolt 712 and coupled to the rotation shaft 230 or the rotor 220, a first fixed end 725*b* extending from the fixed shaft 725*a* to the outer circumferential surface of the bolt 712, and a second fixed end 725*c* spaced apart from the first fixed end 725*b* with respect to the fixed shaft 725*a* and extending to the outer circumferential surface of the bolt 712. The first fixed end 725*b* and the second fixed end 725*c* may extend from the fixed shaft 725*a* to hold the bolt 712, thereby preventing the bolt 712 from rotating arbitrarily.

Figure 4E:
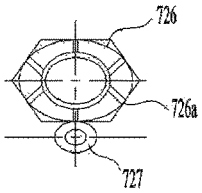

Referring to FIG. 4E, the first fastening member 710 is disposed as the screw 711. Further, the fixing member 720 may include a third nut 726 coupled to an outer circumferential surface of the screw 711 to fix the screw to the rotation shaft 230, and a coupling pin 727 passing through the third nut 726 to fix the screw 911. That is, the third nut 726 may include a plurality of coupling holes 726*a* penetrating outer circumferential surface and inner circumferential surface of the third nut 726. Further, the coupling pin 727 may be inserted into at least one of the coupling holes to prevent the third nut 726 and the screw 711 from rotating arbitrarily.

For example, the lower scroll compressor 10 may use the first fastening member 710 to couple the oil-separator 600 to the drive unit 200, and use the fixing member 720 to prevent the oil-separator 600 from being separated from the drive unit 200.

Both the first fastening member and the fixing member 720 may be accommodated in the circumferential body 612 and coupled to the rotation shaft 230. In addition, the fixing member 720 may prevent the first fastening member 710 from rotating arbitrarily in the coupling body 611.

Figure 5A:
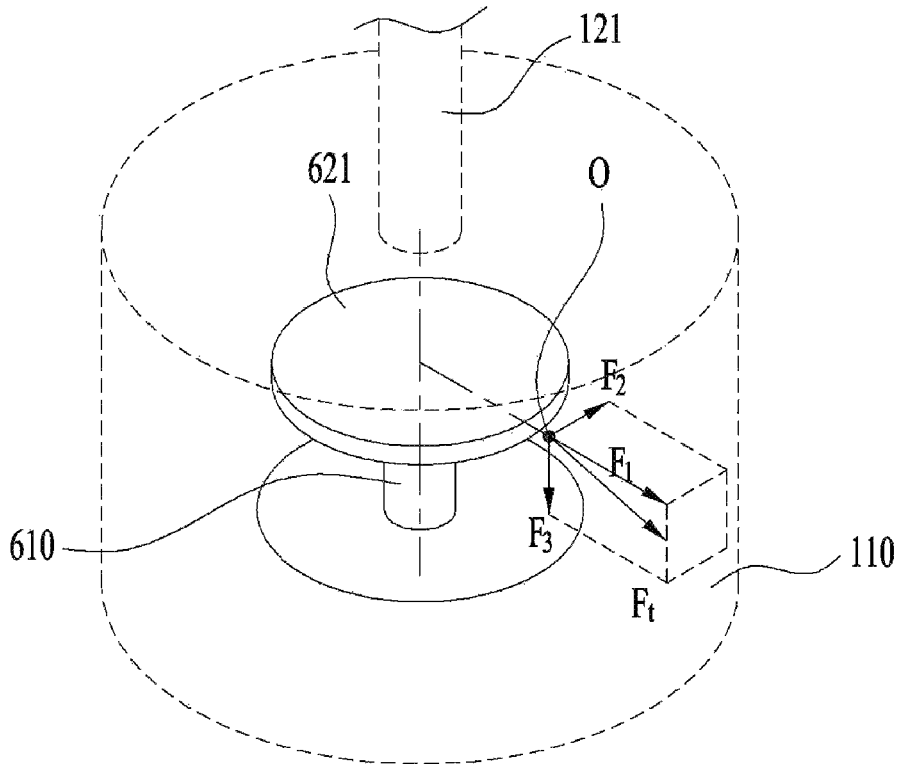
FIGS. 5A and 5B are conceptual diagrams illustrating the oil-separator.
Figure 5B:
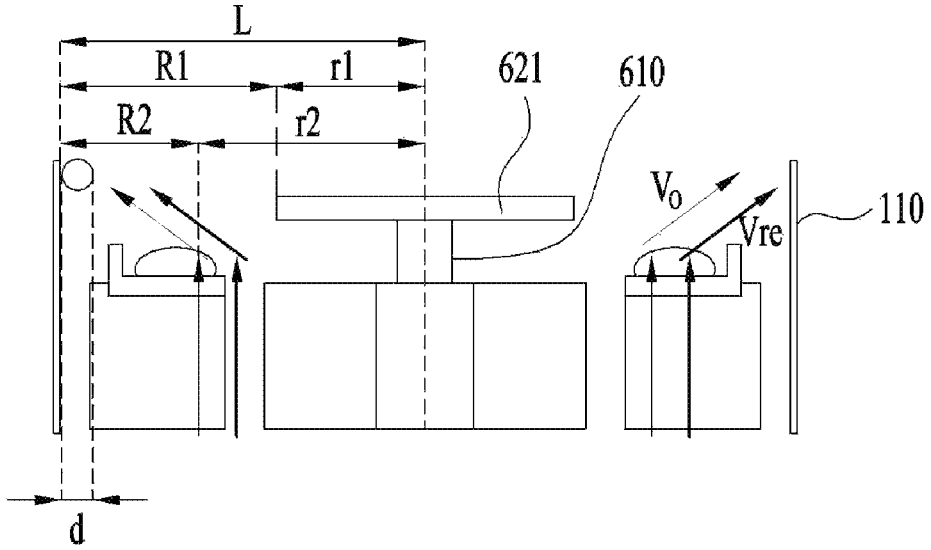

FIGS. 5A and 5B are conceptual diagrams illustrating the oil-separator 600 centrifuging the oil from the refrigerant.

FIGS. 5A and 5B illustrate the oil-separator 600 including the rotating body 621 coupled to the coupler 610. In some examples, the extended body 622 may be further included on the rotating body 621.

Referring to FIG. 5A, the oil-separator 600 may be provided as the rotating body 621 coupled to the coupler 610. When the refrigerant and the oil compressed in the compression unit 300 are supplied to the space between the drive unit 200 and the discharge part 121, the refrigerant and oil may become close to the rotating body 621.

When the rotating body 621 is rotated, the rotating body 621 provides a centrifugal force F1 for pushing the refrigerant and the oil to the receiving shell 110. In addition, the refrigerant and the oil receive gravity F3 by weights thereof. In addition, the refrigerant and the oil also receive a drag force F2 generated as the rotating body 621 is in contact with and rotates the oil and the refrigerant.

In addition, the space between the discharge part 121 and the drive unit 200 has a higher pressure than the outside of the casing 100 by the compressed refrigerant or oil. Therefore, the pressure difference also acts on the refrigerant and the oil.

In this situation, the refrigerant has the density, particle diameter, viscosity less than those of the oil, so that the refrigerant receives the centrifugal force F1 and the drag force F2 less than the oil at the same rotational speed and has a smaller gravity. Therefore, the refrigerant may be more affected by the pressure difference than a total force Ft of the centrifugal force F1, the gravity F3, and the drag force F2. Therefore, the refrigerant may always be discharged to the discharge part 121 irrespective of the rotational speed of the rotating body 621.

However, unlike the refrigerant, the oil is greatly affected by the centrifugal force F1, the drag force F2, and the gravity F3 because the oil has the density, the particle diameter, and the viscosity greater than those of the refrigerant. In particular, as the speed of the rotating body 621 becomes faster, the centrifugal force F1 and the drag force F2 greatly act than other forces. Therefore, as the rotating speed of the rotating body 621 becomes faster, the centrifugal force F1 among the forces exerted on the oil becomes the greatest. Thus, the oil may collide with the inner wall of the shell 110 and be separated from the refrigerant. The oil particles collided with the inner wall of the casing 100 may grow into the droplet due to the viscosity thereof and accordingly receive the gravity, thereby being recovered into the oil storage space P of the casing 100.

For example, when the rotating body 621 rotates at a high speed, an effect of centrifugal separation is further increased, and thus a separation efficiency in which the oil is separated from the refrigerant may be greatly increased. That is, in the oil-separator 600 of a centrifuge type, it may be seen that the efficiency in which the oil is separated from the refrigerant increases as the refrigerant and the oil flow faster.

In some implementations, the rotating body 621 rotates at the same rpm as the rotation shaft 230. Therefore, as the rotating body 621 rotates at a high speed, the rotation shaft 230 also rotates at a high speed. For example, the orbiting scroll 330 of the compression unit 300 may also be operated at a high speed, so that the refrigerant may be compressed more. As the refrigerant is compressed more strongly, the refrigerant flows toward the discharge part 121 at a higher speed, and the oil flows together with the refrigerant.

In some implementations, the larger and faster the particle, the greater the centrifugal force F1, and the smaller and faster the particle, the greater the drag force F2. As a flow rate of a particle of fluid becomes faster, the fluid is dispersed and becomes smaller. That is, it may be seen that the efficiency in which the oil is separated from the refrigerant of the oil-separator 600 of the centrifuge type decreases as the flow speeds of the refrigerant and the oil become faster.

In addition, when the oil particles collide with each other, the oil particles lump together and grow into the larger droplet. Therefore, when the oil particles easily collide with the inner wall of the casing 100, the oil particles may lump together into the larger droplet, thereby increasing the separation efficiency. In other words, as lengths of the outer circumferential surface of the rotating body 621 and the inner circumferential surface of the casing 100 become shorter, the separation efficiency may increase. In some examples, the larger the viscosity of the oil, the easier the oil particles are to grow into the droplet, so that the separation efficiency may be further increased.

In some implementations, the efficiency in which the oil is separated from the refrigerant may be determined in consideration of weights by various variables such as rpm of the rotation shaft 230, rpm of the rotating body 621, the viscosity, the particle diameter, and the flow rate of the oil. For example, a formula in which the oil is separated from the refrigerant may be expressed as follows.

$$V_o > \frac{18\mu R^2}{P_p d^2 L}$$

Vo is an inflow rate of the oil and the refrigerant; Mu (μ) is the viscosity of the oil; P is the density of the oil; R is a distance between a particle center and the inner wall of the casing; L is an orbiting distance of an internal particle; and "d" is the diameter of the oil particle. When analyzing the above formula, the oil may be separated from the refrigerant more easily as the inflow rate of the oil is higher than a result value of a formula on the right. That is, the efficiency in which the oil is separated from the refrigerant may increase as the inflow rate of the oil is greater than the result value of the formula on the right, and conversely, the smaller the result value of the formula on the right, the greater the efficiency in which the oil is separated from the refrigerant.

In some examples, L is a fixed value because L corresponds to the diameter of the casing 100, P and μ are characteristic values of the oil, and the particle diameter "d" decreases when the flow rate of the oil is high. In some examples, the R value may be adjusted. For example, the smaller R is, the smaller the value of the formula on the right in proportion to the square, so that when R is small, the oil separation efficiency may be greatly increased regardless of the inflow rate or the rotation speed of the oil.

Referring to FIG. 5B, the oil and the refrigerant are compressed in the compression unit 300 as the rotation shaft 230 rotates, so that the oil and the refrigerant may respectively flow into the discharge part 121 at a flow rate of the oil Vo and at a flow rate of the refrigerant Vre. In some examples, the Vo and the Vre may not be significantly different from each other or may be the same.

In some examples, the orbiting distance or orbiting radius L may be a sum of a radius r1 of the rotating body 621 and a distance R1 between the outer circumferential surface of the rotating body 621 and the inner wall of the casing. In some examples, when the radius of the rotating body 621 is expanded to a larger radius r2, a distance R2 between the outer circumferential surface of the rotating body 621 and the inner wall of the casing may be reduced. In some examples, because R is the distance between the particle center and the inner wall of the casing, R may correspond to the distance between the outer circumferential surface of the rotating body 621 and the inner wall of the casing 100. Therefore, the larger the radius of the rotating body 621, the distance R2 between the outer circumferential surface of the rotating body 621 and the inner wall of the casing may be reduced, thereby maximizing the oil separation efficiency.

Figure 6A:
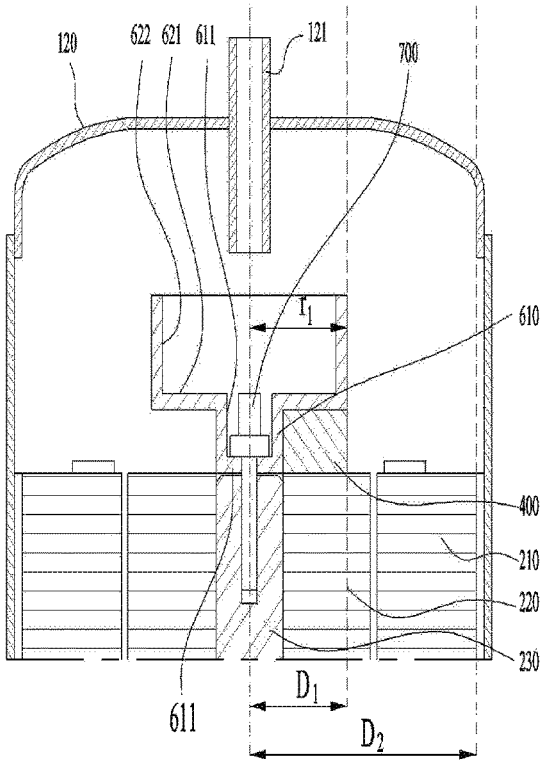
FIGS. 6A and 6B illustrate an example of an oil-separator.
Figure 6B:
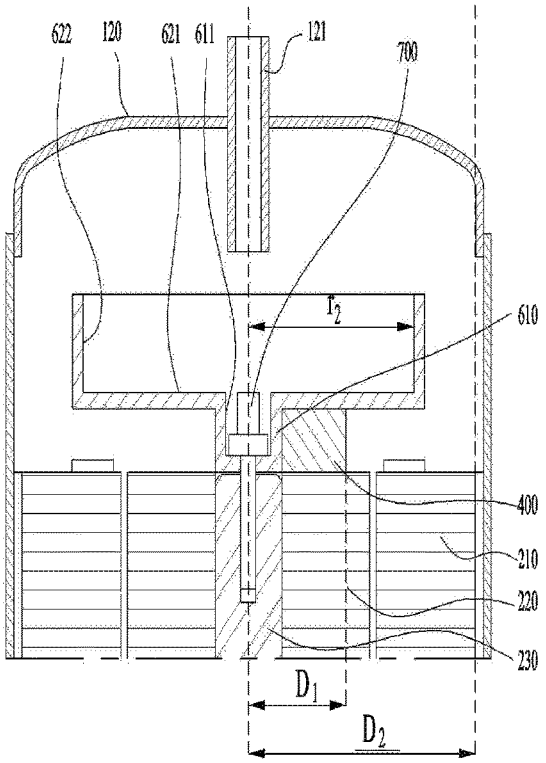

FIGS. 6A and 6B illustrate examples of the oil-separator 600 to maximize the oil separation efficiency in the oil-separator 600.

As shown in FIG. 6A, in the compressor 10, the rotating body 621 may have the radius r1 equal to or smaller than the radius D1 of the rotor 220. Therefore, most of the refrigerant and the oil passed through the drive unit 200 may be disposed in a space between the inner circumferential surface D2 of the stator 210 and the outer circumferential surface D1 of the rotor, rotate inside of the receiving shell 110, collide with the inner wall of the casing 100, and be recovered.

In some examples, a distance R1 between the oil particle and the inner wall of the casing 100 may correspond to all of difference values between the radius D2 of the stator 210 and the radius D1 of the rotor 220, and difference values between the radius D2 of the stator 210 and the radius r1 of the rotating body 621.

As shown in FIG. 6B, in the compressor 10, the rotating body 621 may have the radius r2 larger than the radius D1 of the rotor 220. That is, the rotating body 621 may extend beyond the outer circumferential surface of the rotor 220 to the inner circumferential surface D2 of the stator. Because the balancer 400 may not be able to extend beyond the outer circumferential surface of the rotor 220, the rotating body 621 may be disposed to extend beyond the outer circumferential surface of the balancer 400. As such, the refrigerant or the oil passed through the drive unit 200 may be disposed closer to the inner wall of the casing 100. Therefore, a distance R2 between the oil particle and the inner wall of the casing 100 may correspond to all of difference values between the radius D2 of the stator 210 and the radius r2 of the rotating body 621.

For example, the R2 value becomes smaller than the R1 value, so that an oil separation efficiency of the compressor according to the additional implementation shown in FIG. 6B may always be higher than that of the compressor according to one implementation shown in FIG. 6A even at the same rotation shaft 230 or rpm of the rotating body 621.

The rotating body 621 may be extended by a specific radius from the coupler 610, and the center of rotation of the coupler 610 is present on the rotation shaft 230, so that the rotating body 621 may stably rotate even when the rotating body is extended to have a radius larger than the radius D1 of the rotor 220. However, the outer circumferential surface R2 of the rotating body 621 may be disposed inward of the inner circumferential surface D2 of the stator to prevent collision between the rotating body 621 and the casing 100.

The radius of the coupler 610 may be smaller than the radius of the rotor 220, so that the moment of inertia may be minimized, and the oil and the refrigerant may not be prevented from passing through the drive unit 200.

Figure 7A:
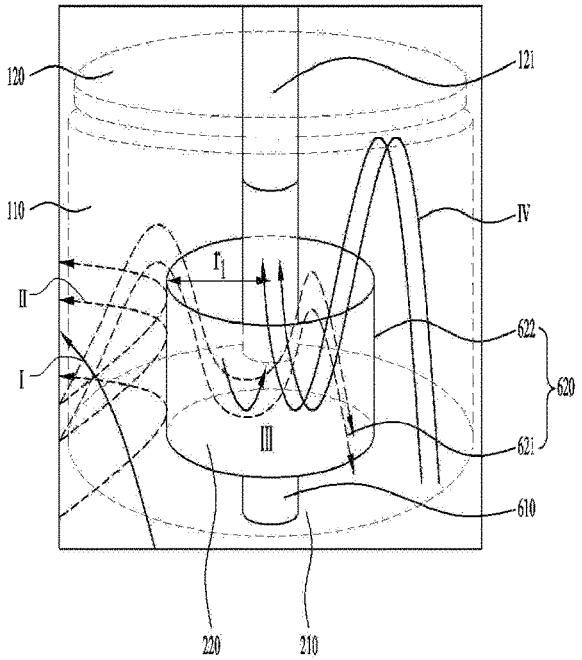
FIGS. 7A and 7B are conceptual diagrams illustrating the oil-separator illustrated in FIGS. 6A and 6B.
Figure 7B:
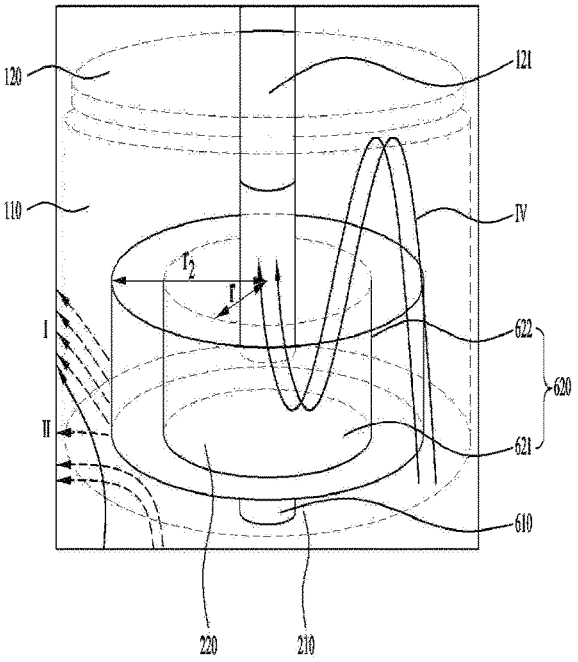

FIGS. 7A and 7B illustrate an example effect of changing a shape of the oil-separator installed in the compressor.

FIG. 7A illustrates that the diameter of the rotating body 621 is smaller than the diameter of the rotor 220, and FIG. 7B illustrates that the diameter of the rotating body 621 is larger than the diameter of the rotor 220.

Referring to FIG. 7A, because the refrigerant has the density, the viscosity, and the particle diameter smaller than those of the oil, the refrigerant may be discharged to the discharge part 121 (IV direction) without being affected by the centrifugal separator 620.

In some implementations, the oil passed through the drive unit 200 may immediately collide with the inner wall of the casing 100 at a flow rate of its own, and be separated from the refrigerant immediately (I direction). However, an amount the separated oil may be insignificant. The oil passed through the drive unit 200 may receive the centrifugal force by the rotation of the centrifugal separator 620 and overcome the drag force, approach the centrifugal separator 620, and change a direction to the inner wall of the casing 100 (II direction).

In addition, some of the oil passed through the drive unit 200 may overcome the centrifugal force because the drag force is instantaneously greater than the centrifugal force, and then be flowed into the extended body 622 together with the refrigerant (III direction). In some examples, the oil flowed into the extended body 622 may be recovered into the extended body 622 because the oil particles collide with each other inside the extended body 622, may be discharged out of the extended body 622 by the centrifugal force and recovered, or may be discharged through the discharge part 121 together with the refrigerant and be lost. In some examples, an amount of the oil flowed into the centrifugal separator 620 may be relatively large.

Referring to FIG. 7B, because the refrigerant has the density, the viscosity, and the particle diameter smaller than those of the oil, the refrigerant may be discharged to the discharge part 121 (IV direction) without being affected by the centrifugal separator 620. In addition, the refrigerant does not grow into the droplet even when the refrigerant collides with a bottom face of the centrifugal separator 620, so that the refrigerant may flow along a surface of the centrifugal separator 620 and be discharged to the discharge part 121.

However, the oil passed through the drive unit 200 may immediately collide with the inner wall of the casing 100 by the flow rate thereof, and may be immediately separated from the refrigerant (I direction), and an amount of the separated oil may be greater.

In addition, because the oil passed through the drive unit 200 is close to the centrifugal separator 620, the oil may receive the immediate centrifugal force, and may collide with an outer wall of the centrifugal separator 620 to grow into the droplet and flow toward the casing 100 (II direction).

Therefore, little or very little oil may be flowed into the centrifugal separator 620.

For example, because the oil is not excessively collected in the centrifugal separator 620, the amount of the oil flowing out of the discharge part 121 may be very small.

Figure 8A:
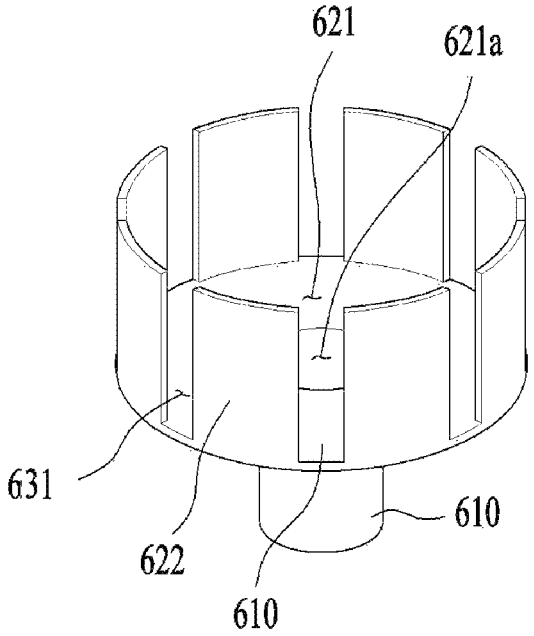
FIGS. 8A and 8B illustrate an example oil-separator.
Figure 8B:
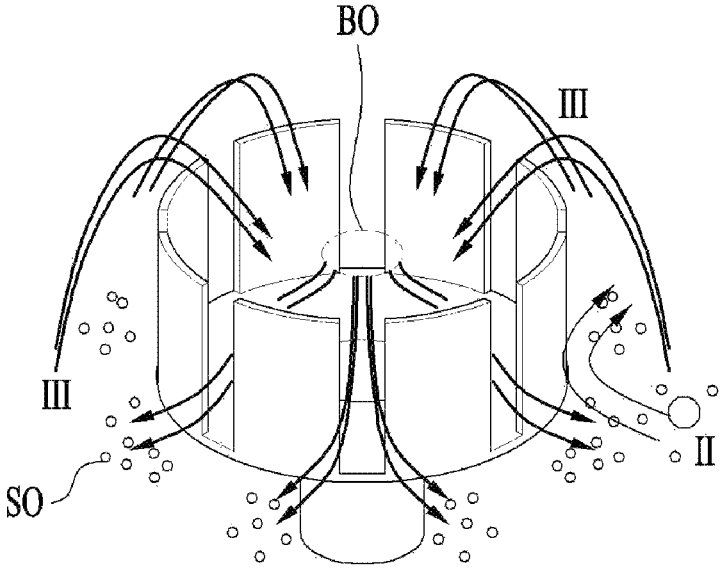

FIGS. 8A and 8B illustrate an example structure that discharges the oil from the oil-separator 600.

Regardless of the diameter of the rotating body 621, when the oil is collected inside the centrifugal separator 620, the oil may not be recovered into the oil storage space P or the oil may be leaked due to a low pressure of the discharge part 121.

Therefore, the oil-separator 600 may further include a discharge part which may immediately discharge the oil when the oil is collected in the centrifugal separator 620.

Referring to FIG. 8A, the oil-separator 600 may include a discharge slit 631 defined by cutting a portion of an outer circumferential surface of the extended body 622. The discharge slit 631 may have a length longer than a width. A plurality of discharge slits 631 may be defined along the outer circumferential surface of the extended body 622. The discharge slit 631 may have a height from a free end of the extended body 622 to the rotating body 621.

A thickness of the discharge slit 631 may be smaller than a thickness of a portion of the extended body 622 disposed between two adjacent discharge slits 631. Thus, the centrifugal force sufficient for the oil located outside the extended body 622 may be provided to the extended body 622.

Referring to FIG. 8B, the oil may be collected into the extended body 622 and the oil particles may collide with each other to grow into a large droplet BO. In some examples, the oil inside the extended body 622 may receive the centrifugal force due to the rotation of the rotating body 621 to flow to the inner wall of the extended body 622, pass through the discharge slit 631, and be discharged out of the extended body 622 (III direction). The oil located outside the extended body 622 may receive the centrifugal force by the rotation of the extended body 622 to flow to the casing 100 (II direction).

For example, it is possible to prevent the oil from being collected in the centrifugal separator 620 and stagnating.

Figure 9A:
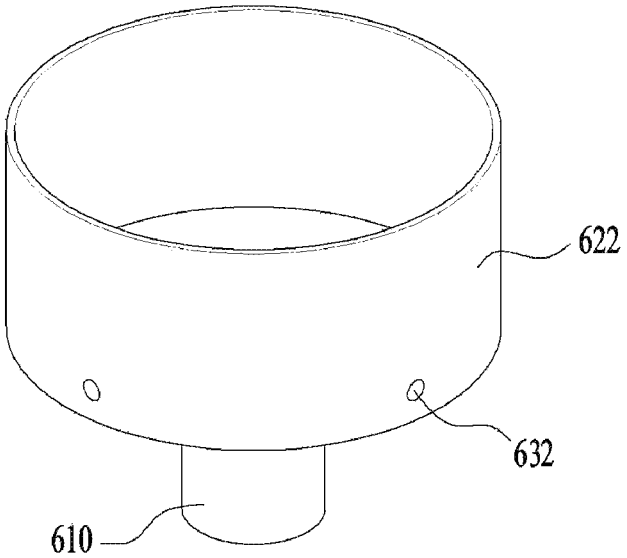
FIGS. 9A and 9B illustrate example oil-separators.
Figure 9B:
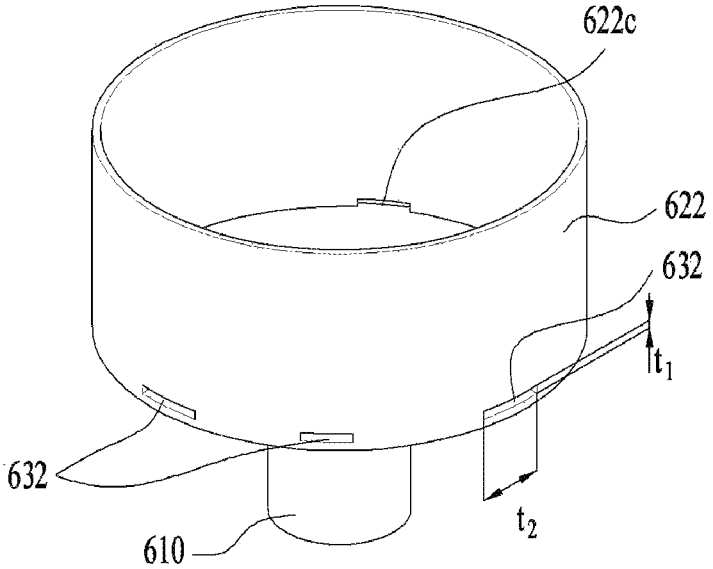

FIGS. 9A and 9B illustrate examples of the discharge opening.

For example, the discharge opening may include a discharge hole 632 defined passing through the extended body 622. The oil, collected in the extended body 622, may receive the centrifugal force when the extended body 622 rotates, and may be discharged through the discharge hole 632.

In some examples, where most of an area of the extended body 622 is maintained, the oil may be separated from the refrigerant and collide with the inner wall of the casing 100 by applying a strong centrifugal force to the oil located outside of the extended body 622.

Referring to FIG. 9A, the discharge hole 632 may be defined adjacent to the rotating body in the extended body. For instance, the discharge hole 632 has a circular shape and is disposed closer to the rotating body than to an upper end of the extended body. This is to discharge all the oil accommodated inside the extended body 622 because the oil collected in the extended body is mostly stacked from the rotating body 621 by its own weight.

In some implementations, the discharge hole 632 may be defined at a certain vertical level spaced apart from the rotating body 621. This is to shape the discharge hole 632 while maintaining a circular shape thereof without interfering with the rotating body 621 as much as possible. Due to the centrifugal force, the oil inside the extended body 622 is swept up along an inner wall of the extended body 622, so that the oil may be sufficiently discharged through the discharge hole 632.

Referring to FIG. 9B, a width t2 extending in a circumferential direction of the rotating body of the discharge hole 630 may be larger than a height t1 extending in a height direction of the extended body. For example, the discharge hole 630 extends (i) along the circumference by the width t2 and (ii) in an axial direction by the height t1. The axial direction of the extended body 622 corresponds to the height direction from the rotating body toward an end of the extended body 622. In some examples, the oil stacked from the rotating body 621 and accommodated may be firstly induced to be easily discharged through the discharge hole 632, thereby immediately reducing a vertical level of the oil.

Figure 10A:
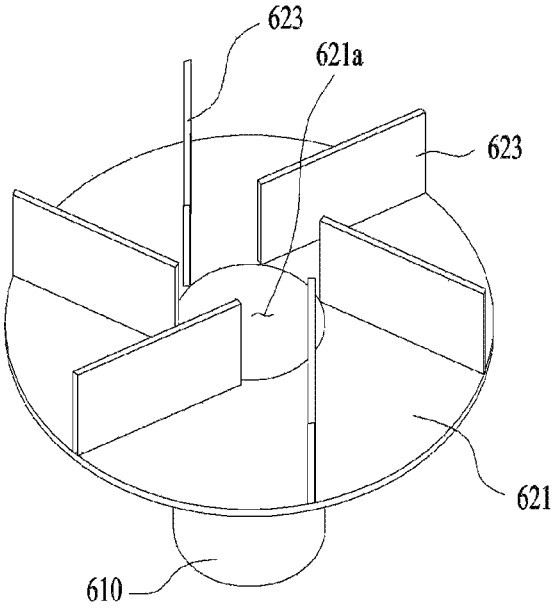
FIGS. 10A and 10B illustrate an example oil-separator.
Figure 10B:
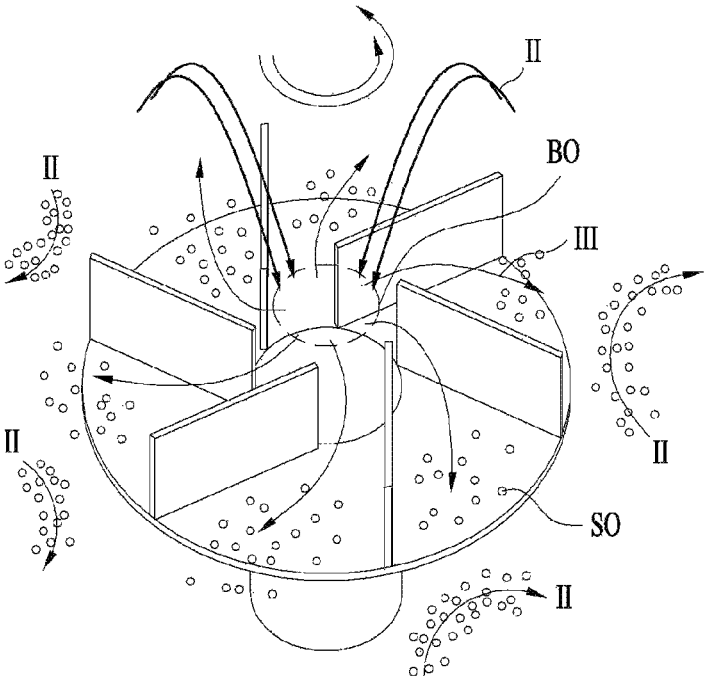

FIGS. 10A and 10B illustrate an example of a structure that generates the centrifugal force while discharging the oil from the oil-separator 600.

Referring to FIG. 10A, the compressor according to an implementation may include an extended vane 623 extending from the coupler 610 toward the outer circumferential surface of the centrifugal separator 620.

The centrifugal separator 620 may be provided as the rotating body 621 extending from an outer circumferential surface of the circumferential body 612, and the extended vane 623 may extend from the rotating body 621 toward the discharge part 121. The extended vane 623 may include a plurality of extended vanes protruding from the rotating body 621 like an impeller.

The extended vane 623 may extend radially in parallel with a radial direction from the rotating body 621. However, in order to further extend a length of the extended vane 623, the extended vane 623 may be inclined with respect to the radial direction of the rotating body 621. In some examples, the extended vane 623 may be inclined based on the rotation direction of the rotating body 621. That is, a spacing between the extended vane and a radial line of the rotating body may increase as the extended vane extends from the outer circumferential surface of the coupler to the outer circumferential surface of the centrifugal separator.

In some examples, one end of the extended vane 623 may be located at the outer circumferential surface of the circumferential body 612 or at a central portion 621*a* defined by passing through the rotating body 621, and the other end thereof may be extended to be located at the inner circumferential surface of the rotating body. Thus, the extended vane 623 may very effectively push the oil to the inner wall of the casing 100 while rotating together with the rotating body 621 like the fan or the impeller. The extended body 622 may be omitted outward of the extended vane 623, so that the oil flowed into the extended vane 623 may be effectively discharged.

In some examples, each extended vane 623 may be disposed between each discharge slit and each discharge hole to divide an inside of the extended body 622. Thus, the accommodated oil may be induced to concentrate to the nearest discharge opening and be discharged therethrough.

In addition, the extended vane 623 may extend vertically from the rotating body 621, but may be inclined from the rotating body 621 with respect to the rotation shaft direction. Therefore, the refrigerant may be induced to be effectively discharged to the discharge part 121.

Referring to FIG. 10B, the oil particles flowed into the centrifugal separator 620 may collide with each other to grow into the large droplet BO. In some examples, when the rotating body 621 is rotated, the large droplet BO may be dispersed into the small droplet SO. In some examples, the small droplets SO may approach the nearest extended vane 623, simultaneously receive the centrifugal force and a pressing force of the extended vane 623 pushing the small droplets SO, and be discharged out of the rotating body 621.

In addition, because the extended vane 623 serves as the impeller, the extended vane 623 may provide strong wind power as well as the centrifugal force to the outside of the rotating body 621. Therefore, the oil flowed to a vicinity of the rotating body 621 may flow to the inner wall of the casing (II direction) without being flowed into the rotating body 621. The refrigerant may be discharged to the discharge part 121 by a pressure difference without being affected by the extended vane 623 because the refrigerant has small particle diameter and density. Even when the refrigerant is pushed to the inner wall of the casing 100, the refrigerant may be discharged to the discharge part 121 without growing into the droplet.

Therefore, the efficiency of the oil separation from the refrigerant may be improved.

Figure 11A:
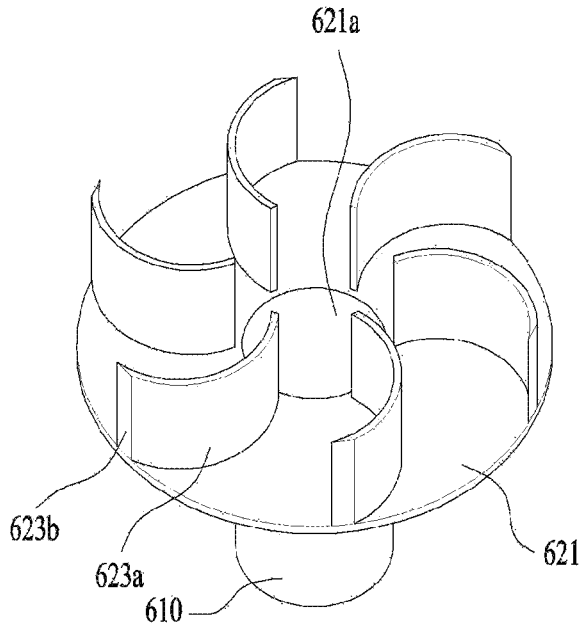
FIGS. 11A and 11B illustrate an example oil-separator.
Figure 11B:
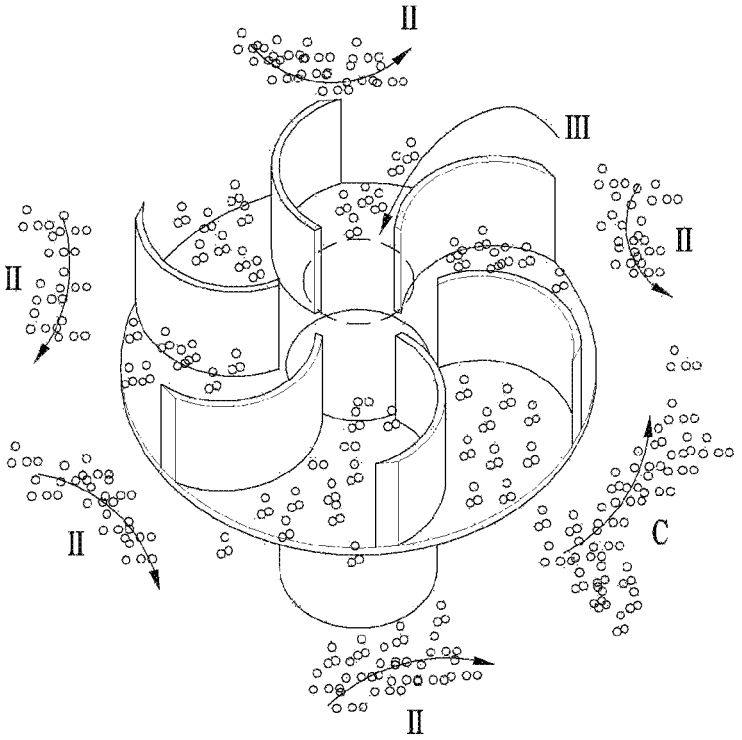

FIGS. 11A and 11B illustrate an example of the extended vane 623.

Referring to FIG. 11A, the extended vane 623 may extend from the coupler 610 toward the outer circumferential surface of the centrifugal separator 620 in a curved manner. For example, the extended vane 623 may be curved and extend from a central portion of the rotating body 621 to an inner circumferential surface of the extended body 622.

That is, the extended vane 623 may extend in the curved manner rather than extend in a straight line. The extended vane 623 may be curved rearwards with respect to the rotational direction outwardly to lower a resistance and generate a stronger wind power.

In some implementations, the extended vane 623 may include a first curved portion 623*a* extending from an outer circumferential surface of the coupler and having a radius of curvature different from that of the outer circumferential surface of the centrifugal separator, and a second curved portion 623*b* extending from the first curved portion 623*a* to the outer circumferential surface of the centrifugal separator and having a radius of curvature equal to the radius of curvature of the outer circumferential surface of the centrifugal separator.

The first curved portion 623*a* may have the radius of curvature smaller than that of the rotating body 621. Thus, the extended vane 623 may be curved more. However, the second curved portion 623*b* may have the same radius of curvature as that of the rotating body 621. Thus, when the second curved portion 623*b* extends to the outer circumferential surface of the rotating body 621, it is possible to prevent an end of the second curved portion 623*b* from protruding beyond the outer circumferential surface of the rotating body 621 or to facilitate a fabrication of the centrifugal separator 620.

Referring to FIG. 11B, the oil flowed into the centrifugal separator 620 may collide with each other to grow into the large droplet BO. In some examples, when the rotating body 621 is rotated, the large droplet BO may be dispersed into the small droplet SO. In some examples, the small droplets SO may approach the nearest extended vane 623, simultaneously receive the centrifugal force and the pressing force of the extended vane 623 pushing the small droplets SO, and be discharged out of the rotating body 621.

In addition, because the extended vane 623 serves as the impeller, the extended vane 623 may provide strong wind power as well as the centrifugal force to the outside of the rotating body 621. Therefore, the oil flowed to a vicinity of the rotating body 621 may directly flow to the inner wall of the casing (II direction) without being flowed into the rotating body 621. The refrigerant may be discharged to the discharge part 121 by the pressure difference without being affected by the extended vane 623 because the refrigerant has the small particle diameter and density. Even when the refrigerant is pushed to the inner wall of the casing 100, the refrigerant may be discharged to the discharge part 121 without growing into the droplet.

In some examples, the extended vane 623 is curved to provide the stronger wind power and to effectively disperse the oil.

Therefore, the efficiency of the oil separation from the refrigerant may be improved.

Figure 12A:
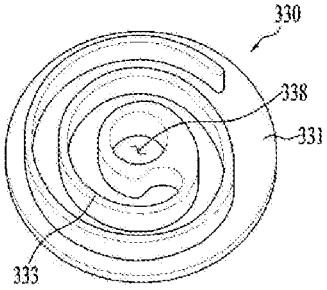
FIGS. 12A to 12C illustrate an example of an operation scheme of the compressor.
Figure 12B:
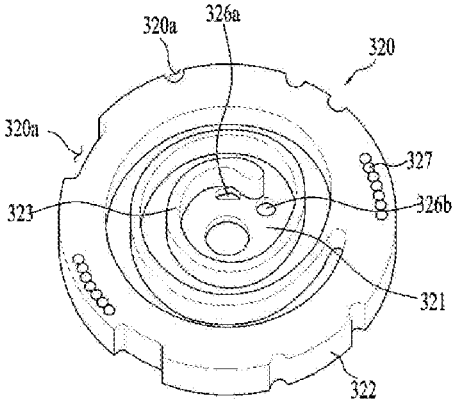
Figure 12C:
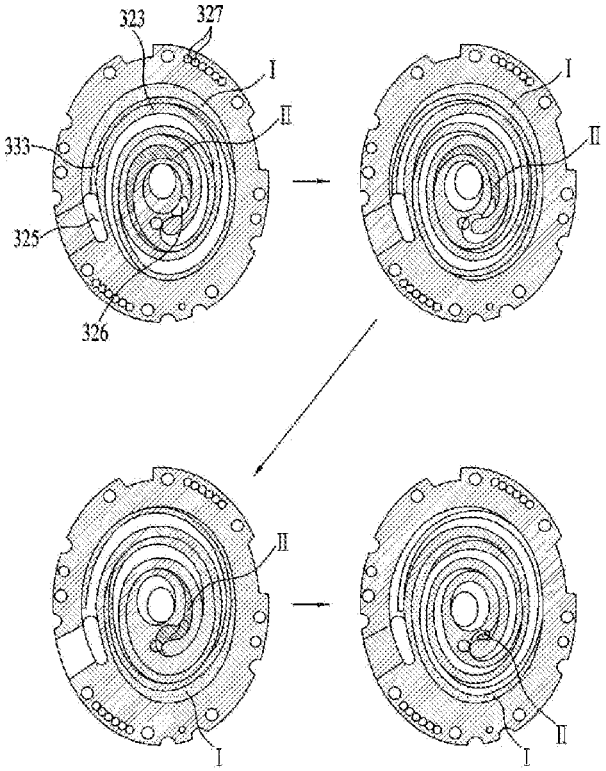

FIGS. 12A to 12C illustrate an example of an operating aspect of the scroll compressor 10.

FIG. 12A illustrates the orbiting scroll, FIG. 12B illustrates the fixed scroll, and FIG. 12C illustrates a process in which the orbiting scroll and the fixed scroll compress the refrigerant.

The orbiting scroll 330 may include the orbiting wrap 333 on one face of the orbiting end plate 331, and the fixed scroll 320 may include the fixed wrap 323 on one face of the fixed end plate 321.

In addition, the orbiting scroll 330 is provided as a sealed rigid body to prevent the refrigerant from being discharged to the outside, but the fixed scroll 320 may include the inflow hole 325 in communication with a refrigerant supply pipe such that the refrigerant in a liquid phase of a low temperature and a low pressure may inflow, and the discharge hole 326 through which the refrigerant of a high temperature and a high pressure is discharged. Further, the bypass hole 327 through which the refrigerant discharged from the discharge hole 326 is discharged may be defined in an outer circumferential surface of the fixed scroll 320.

In some implementations, the fixed wrap 323 and the orbiting wrap 333 may be formed in an involute shape and at least two contact points between the fixed wrap 323 and the orbiting wrap 333 may be formed, thereby defining the compression chamber.

The involute shape refers to a curve corresponding to a trajectory of an end of a yarn when unwinding the yarn wound around a base circle having an arbitrary radius as shown.

However, in the present disclosure, the fixed wrap 323 and the orbiting wrap 333 are formed by combining 20 or more arcs, and radii of curvature of the fixed wrap 323 and the orbiting wrap 333 may vary from part to part.

That is, the compressor is disposed such that the rotation shaft 230 penetrates the fixed scroll 320 and the orbiting scroll 330, and thus the radii of curvature of the fixed wrap 323 and the orbiting wrap 333 and the compression space are reduced.

Thus, in order to compensate for this, in the compressor, radii of curvature of the fixed wrap 323 and the orbiting wrap 333 immediately before the discharge may be smaller than that of the penetrated shaft receiving portion of the rotation shaft such that the space to which the refrigerant is discharged may be reduced and a compression ratio may be improved.

That is, the fixed wrap 323 and the orbiting wrap 333 may be more severely bent in the vicinity of the discharge hole 326, and may be more bent toward the inflow hole 325, so that the radii of curvature of the fixed wrap 323 and the orbiting wrap 333 may vary point to point in correspondence with the bent portions.

Referring to FIG. 12C, refrigerant I is flowed into the inflow hole 325 of the fixed scroll 320, and refrigerant II flowed before the refrigerant I is located near the discharge hole 326 of the fixed scroll 320.

In this case, the refrigerant I is present in a region at outer circumferential surfaces of the fixed wrap 323 and the orbiting wrap 333 where the fixed wrap 323 and the orbiting wrap 333 are engaged with each other, and the refrigerant II is enclosed in another region in which the two contact points between the fixed wrap 323 and the orbiting wrap 333 exist.

Thereafter, when the orbiting scroll 330 starts to orbit, as the region in which the two contact points between the fixed wrap 323 and the orbiting wrap 333 exist is moved based on a position change of the orbiting wrap 333 along an extension direction of the orbiting wrap 333, a volume of the region begins to be reduced, and the refrigerant I starts to flow and be compressed. The refrigerant II starts to be further reduced in volume, be compressed, and guided to the discharge hole 326.

The refrigerant II is discharged from the discharge hole 326, and the refrigerant I flows as the region in which the two contact points between the fixed wrap 323 and the orbiting wrap 333 exist moves in a clockwise direction, and the volume of the refrigerant I decreases and starts to be compressed more.

As the region in which the two contact points between the fixed wrap 323 and the orbiting wrap 333 exist moves again in the clockwise direction to be closer to an interior of the fixed scroll, the volume of the refrigerant I further decreases and the refrigerant II is almost discharged.

As such, as the orbiting scroll 330 orbits, the refrigerant may be compressed linearly or continuously while flowing into the fixed scroll.

Although the drawing shows that the refrigerant flows into the inflow hole 325 discontinuously, this is for illustrative purposes only, and the refrigerant may be supplied continuously. Further, the refrigerant may be accommodated and compressed in each region where the two contact points between the fixed wrap 323 and the orbiting wrap 333 exist.

Effects as not described herein may be derived from the above configurations. The relationship between the above-described components may allow a new effect not seen in the conventional approach to be derived.

In addition, implementations shown in the drawings may be modified and implemented in other forms. The modifications should be regarded as falling within a scope when the modifications is carried out so as to include a component claimed in the claims or within a scope of an equivalent thereto.

What is claimed is:

1. A compressor comprising:

a casing including a discharge part for discharging a refrigerant on one side and a reservoir space for storing oil;

a drive unit comprising:

a stator coupled to an inner circumferential surface of the casing and configured to generate a rotating magnetic field, and a rotor accommodated in the stator and configured to rotate relative to the stator based on the rotating magnetic field;

a rotation shaft coupled to the rotor and configured to be rotated by the rotor;

a compression unit that is coupled to the rotation shaft, that is lubricated with the oil, and that is configured to compress and discharge the refrigerant; and an oil-separator that is disposed between the discharge part and the drive unit and that is configured to separate the oil from the refrigerant and guide the refrigerant to the discharge part, the oil-separator comprising:

a centrifugal separator that is configured to rotate together with the rotation shaft and that is configured to generate a centrifugal force to separate the oil from the refrigerant, a coupler that is coupled to the rotor or the rotation shaft and that is configured to rotate the centrifugal separator based on rotation of the rotating shaft, and a fastening member that couples the coupler to the rotation shaft, wherein the coupler comprises:

a circumferential body that axially extends from the centrifugal separator and receives the fastening member, a diameter of the circumferential body being less than a diameter of the centrifugal separator, and a coupling body that extends radially inward from the circumferential body and axially faces the rotation shaft.

2. The compressor of claim 1, wherein the coupler and the rotation shaft are coaxial.

3. The compressor of claim 1, further comprising:

a balancer that is spaced apart from the coupler, that is coupled to the rotor, and that is configured to compensate for eccentricity of the rotation shaft.

4. The compressor of claim 3, wherein a top surface of the coupler is flush with a top surface of the balancer.

5. The compressor of claim 4, wherein the centrifugal separator extends from the coupler and is seated on an end of the balancer.

6. The compressor of claim 4, wherein the centrifugal separator further extends radially outward relative to an end of the balancer.

7. The compressor of claim 1, wherein the fastening member comprises:

a fastening part that passes through the coupler and that is coupled to the rotation shaft; and a fixing member coupled to the fastening part and configured to restrict rotation of the fastening member relative to the circumferential body.

8. The compressor of claim 1, wherein the fastening member passes through the coupling body and is inserted into an axial end of the rotating shaft facing the coupling body, and wherein an outer circumferential surface of the fastening member faces and is spaced apart from an inner circumferential surface of the circumferential body.

9. The compressor of claim 8, wherein the outer circumferential surface of the fastening member is in contact with an inner circumferential surface of the coupling body.

10. A compressor comprising:

a casing including a discharge part for discharging a refrigerant on one side and a reservoir space for storing oil;

a drive unit comprising:

a stator coupled to an inner circumferential surface of the casing and configured to generate a rotating magnetic field, and a rotor accommodated in the stator and configured to rotate relative to the stator based on the rotating magnetic field;

a rotation shaft coupled to the rotor and configured to be rotated by the rotor;

a compression unit that is coupled to the rotation shaft, that is lubricated with the oil, and that is configured to compress and discharge the refrigerant; and an oil-separator that is disposed between the discharge part and the drive unit and that is configured to separate the oil from the refrigerant and guide the refrigerant to the discharge part, the oil-separator comprising:

a coupler coupled to the rotation shaft or the rotor, a centrifugal separator that is coupled to or extends from the coupler and that is configured to generate a centrifugal force to separate the oil from the refrigerant, the centrifugal separator comprising a rotating body that defines a diameter of the centrifugal separator greater than a diameter of the rotor and is configured to generate the centrifugal force, and a fastening member that couples the coupler to the rotation shaft, wherein the coupler comprises:

a circumferential body that axially extends from the centrifugal separator and receives the fastening member, a diameter of the circumferential body being less than the diameter of the centrifugal separator, and a coupling body that extends radially inward from the circumferential body and axially faces the rotation shaft.

11. The compressor of claim 10, wherein the rotating body extends from an outer circumferential surface of the circumferential body, and wherein an outer circumferential surface of the rotating body is located between an outer circumferential surface of the rotor and an inner circumferential surface of the stator.

12. The compressor of claim 11, wherein the diameter of the circumferential body is less than the diameter of the rotor.

13. The compressor of claim 11, wherein the centrifugal separator further comprises an extended body that extends from the rotating body toward the discharge part and that is configured to receive the oil separated from the refrigerant.

14. A compressor comprising:

a casing including a discharge part for discharging a refrigerant on one side and a reservoir space for storing oil;

a drive unit comprising:

a stator coupled to an inner circumferential surface of the casing and configured to generate a rotating magnetic field, and a rotor accommodated in the stator and configured to rotate relative to the stator based on the rotating magnetic field, a rotation shaft coupled to the rotor and configured to be rotated by the rotor;

a compression unit that is coupled to the rotation shaft, that is lubricated with the oil, and that is configured to compress and discharge the refrigerant; and an oil-separator that is disposed between the discharge part and the drive unit and that is configured to separate the oil from the refrigerant and guide the refrigerant to the discharge part, the oil-separator comprising:

a coupler that is coupled to the rotation shaft or the rotor, a centrifugal separator that extends from the coupler, that is configured to generate a centrifugal force to separate the oil from the refrigerant, and that defines a discharge opening configured to discharge the oil from the centrifugal separator, and a fastening member that couples the coupler to the rotation shaft, wherein the coupler comprises:

a circumferential body that axially extends from the centrifugal separator and receives the fastening member, a diameter of the circumferential body being less than a diameter of the centrifugal separator, and a coupling body that extends radially inward from the circumferential body and axially faces the rotation shaft.

15. The compressor of claim 14, wherein the centrifugal separator comprises:

a rotating body that radially extends from the circumferential body and defines the diameter of the centrifugal separator; and an extended body that extends from the rotating body toward the discharge part, and wherein the discharge opening comprises a discharge slit that is cut along a portion of the extended body and that extends toward the discharge part.

16. The compressor of claim 14, wherein the centrifugal separator comprises:

a rotating body that radially extends from the circumferential body and defines the diameter of the centrifugal separator; and an extended body that extends from the rotating body toward the discharge part, and wherein the discharge opening comprises a discharge hole that passes through the extended body.

17. The compressor of claim 16, wherein the extended body has a first end connected to the rotating body and a second end disposed away from the rotating body, and wherein the discharge hole is disposed closer to the first end of the extended body than to the second end of the extended body.

18. The compressor of claim 17, wherein the discharge hole extends along a circumferential surface of the extended body, and wherein a width of the discharge hole in a circumferential direction of the extended body is greater than a height of the discharge hole in an axial direction of the extended body.

19. A compressor comprising:

a casing including a discharge part for discharging a refrigerant on one side and a reservoir space for storing oil;

a rotor disposed in the casing;

a rotation shaft coupled to the rotor and configured to be rotated by the rotor;

a compression unit that is coupled to the rotation shaft, that is lubricated with the oil, and that is configured to compress and discharge the refrigerant; and an oil-separator that is disposed between the discharge part and the rotor and that is configured to separate the oil from the refrigerant and guide the refrigerant to the discharge part, the oil-separator comprising:

a coupler coupled to the rotation shaft or the rotor, a centrifugal separator that extends from the coupler and that is configured to generate a centrifugal force to separate the oil from the refrigerant, an extended vane that extends from the coupler toward an outer circumferential surface of the centrifugal separator, and a fastening member that couples the coupler to the rotation shaft, wherein the coupler comprises:

a circumferential body that axially extends from the centrifugal separator and receives the fastening member, a diameter of the circumferential body being less than a diameter of the centrifugal separator, and a coupling body that extends radially inward from the circumferential body and axially faces the rotation shaft.

20. The compressor of claim 19, wherein the extended vane has a first end disposed on an outer circumferential surface of the circumferential body and a second end disposed on the outer circumferential surface of the centrifugal separator.

21. The compressor of claim 19, wherein the extended vane is inclined with respect to a radial direction of the rotation shaft.

22. The compressor of claim 19, wherein the extended vane is curved from the coupler to the outer circumferential surface of the centrifugal separator.

23. The compressor of claim 22, wherein the extended vane comprises:

a first curved portion that extends from an outer circumferential surface of the coupler, a radius of curvature of the first curved portion being different from a radius of curvature of the outer circumferential surface of the centrifugal separator; and a second curved portion that extends from the first curved portion to the outer circumferential surface of the centrifugal separator, a radius of curvature of the second curved portion being equal to the radius of curvature of the outer circumferential surface of the centrifugal separator.

24. The compressor of claim 19, wherein the extended vane protrudes from a surface of the centrifugal separator toward the discharge part.

* * * * *